US007201100B1

(12) United States Patent
Davis et al.

(10) Patent No.: US 7,201,100 B1
(45) Date of Patent: Apr. 10, 2007

(54) PNEUMATIC ASSIST BALER DOORS AND PLATEN INTERLOCKS

(76) Inventors: James Davis, 17735 Meadow Wood Dr., Siloam Springs, AR (US) 72761; Gregory W. Staggs, 1077 E. Elm St., Fayetteville, AR (US) 72703

( * ) Notice: Subject to any disclaimer, the term of this patent is extended or adjusted under 35 U.S.C. 154(b) by 148 days.

(21) Appl. No.: 10/841,217

(22) Filed: May 6, 2004

Related U.S. Application Data

(63) Continuation-in-part of application No. 10/315,338, filed on Dec. 9, 2002, now Pat. No. 6,742,448.

(51) Int. Cl.
*B30B 15/14* (2006.01)

(52) U.S. Cl. ..... 100/48; 100/99; 100/345

(58) Field of Classification Search ..... 100/43, 100/45, 48, 99, 341, 345, 347, 226, 229 R, 100/245, 265, 269.18, 269.19
See application file for complete search history.

(56) References Cited

U.S. PATENT DOCUMENTS

| | | | | |
|---|---|---|---|---|
| 3,608,476 A | | 9/1971 | Price | 100/35 |
| 3,802,335 A | | 4/1974 | Longo | 100/35 |
| 4,075,817 A | * | 2/1978 | Gieske, Jr. | 53/526 |
| 4,221,367 A | * | 9/1980 | Smith | 267/64.15 |
| 4,232,599 A | | 11/1980 | Ulrich | 100/25 |
| 4,643,087 A | | 2/1987 | Fenner et al. | 100/35 |
| 4,798,044 A | * | 1/1989 | Viaud et al. | 56/341 |
| 4,953,109 A | | 8/1990 | Burgis | 364/550 |
| 5,016,197 A | | 5/1991 | Neumann et al. | 364/550 |
| 5,390,593 A | * | 2/1995 | Gustavsson | 100/218 |
| 5,409,308 A | * | 4/1995 | Reuter et al. | 312/319.4 |
| 5,558,013 A | | 9/1996 | Blackstone, Jr. | 100/35 |
| 5,685,219 A | * | 11/1997 | Schwelling | 100/345 |
| 5,751,532 A | | 5/1998 | Kanuchok et al. | 361/94 |
| 5,773,945 A | | 6/1998 | Kim et al. | 318/434 |
| 5,816,141 A | * | 10/1998 | Aylsworth et al. | 100/25 |
| 6,055,902 A | | 5/2000 | Harrop et al. | 100/52 |
| 6,394,566 B1 | * | 5/2002 | Slivon et al. | 312/323 |
| 6,707,173 B2 | * | 3/2004 | Bauman et al. | 310/12 |

* cited by examiner

*Primary Examiner*—Ed Tolan
(74) *Attorney, Agent, or Firm*—Keisling Pieper & Scott PLC; David B. Pieper; Trent C. Keisling

(57) ABSTRACT

A baler utilizing gas springs for controlling the movement of a loading door. Also disclosed is a baler for paper recycling having a control system responsive to switches and digital timers, and an electromagnetic interlock coupling a loading door and a chamber door, said control system including a programmable relay having outputs to motor starter, control valves, and electromagnetic interlock. A mode selection switch enables automatic, manual down, and manual up modes, the latter of which is used to eject a bale. The electromagnetic interlock performs multiple functions reducing the number of components needed in the system, improving reliability and reducing maintenance.

8 Claims, 15 Drawing Sheets

PNEUMATIC ASSIST BALER DOORS AND PLATEN INTERLOCKS

CROSS REFERENCE TO RELATED APPLICATIONS

This application claims priority to and is a continuation-in-part application of U.S. patent application Ser. No. 10/315,338, filed Dec. 9, 2002 now U.S. Pat. No. 6,742,448.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The present invention relates to compaction apparatus, particularly waste paper balers and to control apparatus therefore responsive to timers and to chamber door, loading door, and/or platen position sensors for detecting possible unsafe operation of the baler and for disabling or otherwise preventing hazardous operation modes. The particular invention is directed to the use of gas springs in association with the movement of the doors on the baler.

SUMMARY OF THE INVENTION

The present invention relates to compaction equipment for commercial and industrial trash compaction and waste paper baler equipment utilized in paper recycling, which are important and widely used tools in the field of waste management. It is very desirable that this equipment be both efficient and reliable. As with all powerful mechanical equipment, safety hazards should be eliminated to the maximum extent possible, recognizing that there is a tendency for human operators to be less careful than they should be.

Although the invention with which this application is concerned is particularly useful in waste paper balers, this background discussion also concerns itself with trash compactors, since they are both widely used and common forms of equipment. The detailed description below will fully describe balers incorporating the invention. The commercial or industrial waste compactor or baler which will be referred to herein as a "compactor" is found in many situations where there are large volumes of waste to be disposed of in landfills or baled for recycling. Thus, compactors including waste compactors and balers are found in shopping centers, industrial complexes, associated with large discount stores or department stores, and in some residential complexes.

The operation and control of balers according to the invention includes features for controlling the starting, stopping, and reversing of the ram used for driving the platen and compressing the waste paper (usually corrugated paper board from packages and cartons). Features such as interlocks and fault detection functions are included which are important to promote and ensure safety at the point of operation of such powerful mechanical equipment. Also of particular note is the use of gas springs to control the movement of the operator activated doors.

Although operational control of compaction apparatus in years past was usually implemented by simple switches and relays, there has been a tendency in recent years to employ computer microprocessors and somewhat sophisticated computer programs and algorithms stored in computer memory in, or associated with, the microprocessor.

U.S. Pat. No. 4,953,109 to Burgis, U.S. Pat. No. 5,016,197 to Neumann, et al., and U.S. Pat. No. 5,558,013 to Blackstone, Jr. are examples of trash compaction systems utilizing rather complex computer programs to implement the desired control system (including fullness determination in compaction apparatus). These may be compared with U.S. Pat. No. 3,802,335 to Longo, U.S. Pat. No. 4,643,087 to Fenner, et al., and U.S. Pat. No. 6,055,902 to Harrop, et al., which do not employ computer microprocessors but execute simple logic with electrical relays.

Compactors including waste compactors and balers are typically exposed to harsh environments including wide ranges of temperatures and potential exposure to power surges. In addition, it is very important that the compaction equipment operate reliably and operate in a safe manner and not be subject to malfunction because of failure or error conditions in its electrical controls. For that reason, there are many users and others who consider that a relatively simply relay based control system has advantages with regard to reliability, durability, and safety over microprocessor controlled by complex software.

Compactors of the present invention have advantages of simple electromechanical related based control systems as shown in U.S. Pat. No. 6,055,902, disclosure of which is incorporated herein by reference, and at the same time provide an advantage of simple maintainability and low component cost that previous electromechanical related based control systems do not provide.

Included in the operating and control system are combination magnetic locks and position sensors which operate effectively for locking, releasing, and sensing the position of the loading door and the bale chamber door while reducing the total number of sensors and/or interlocks needed in the system.

The present invention departs from the teaching of prior art waste baler paper systems by providing apparatus which is simple, durable, reliable, and capable of being programmed with special features and which provides safe and uncomplicated operation for operating personnel. An important feature of the present invention is the employment of programmable electronic relay networks in a manner to achieve the simplicity and reliability of electrical relay based control systems while achieving the flexibility, programmability, and reduced component costs associated with electromechanical relay or solid state relay control networks.

In addition to providing the features and advantages referred to above, it is an object of the present invention to provide compaction apparatus such as waste paper balers which have the advantages of simple relay-implemented control systems including a safety interlock feature for the bale chamber door, and the loading door while obtaining the advantages of programming flexibility, increased reliability, and reduced component costs.

It is another object of the present invention to utilize combination electromagnetic lock and sensor units for providing control signals to the programmable relay network and receiving control signals from the programmable relay network, thereby reducing the mechanical and electrical elements associated with the control system.

It is yet another object of the present invention to provide waste paper balers with controls utilizing programmable relay networks for timing functions which would otherwise require separate timing elements with less adjustability, greater cost, and greater assembly expense.

It is a further object of the present invention to provide a programmable relay control system for waste paper balers which maximizes simplicity of operation while assuring that electromagnetic interlocks and other safety features prevent improper or unintended operation which could cause property damage or personal injury.

Yet a further object of the present invention is the provision for a damped movement for the operator controlled doors of the baler to provide smoother operation of the doors for improved safety, simplification of operation, and reliability.

In addition to the features and advantages of the baler apparatus according to the invention described above, further advantages thereof will be apparent from the following description in conjunction with the appended drawings.

DETAILED DESCRIPTION OF THE INVENTION

Figure 1:
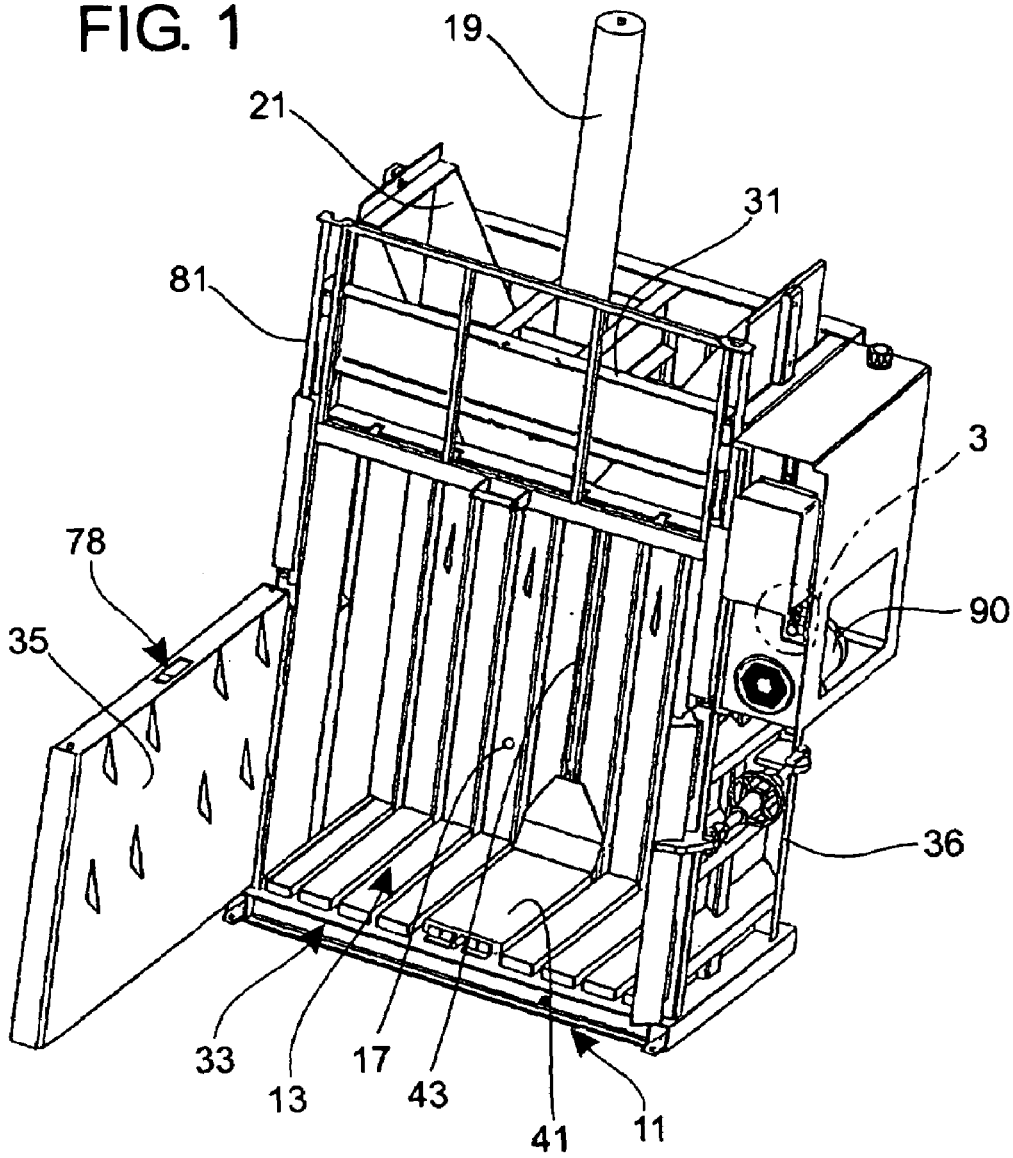
FIG. 1 is an isometric view of a baler according to the present invention.
Figure 3:
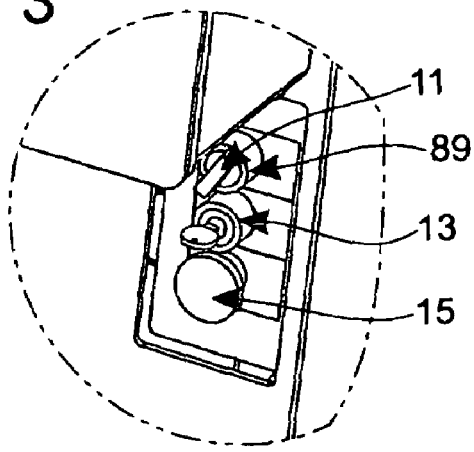
FIG. 3 is an enlarged view of the control panel from FIG. 1.
Figure 2:
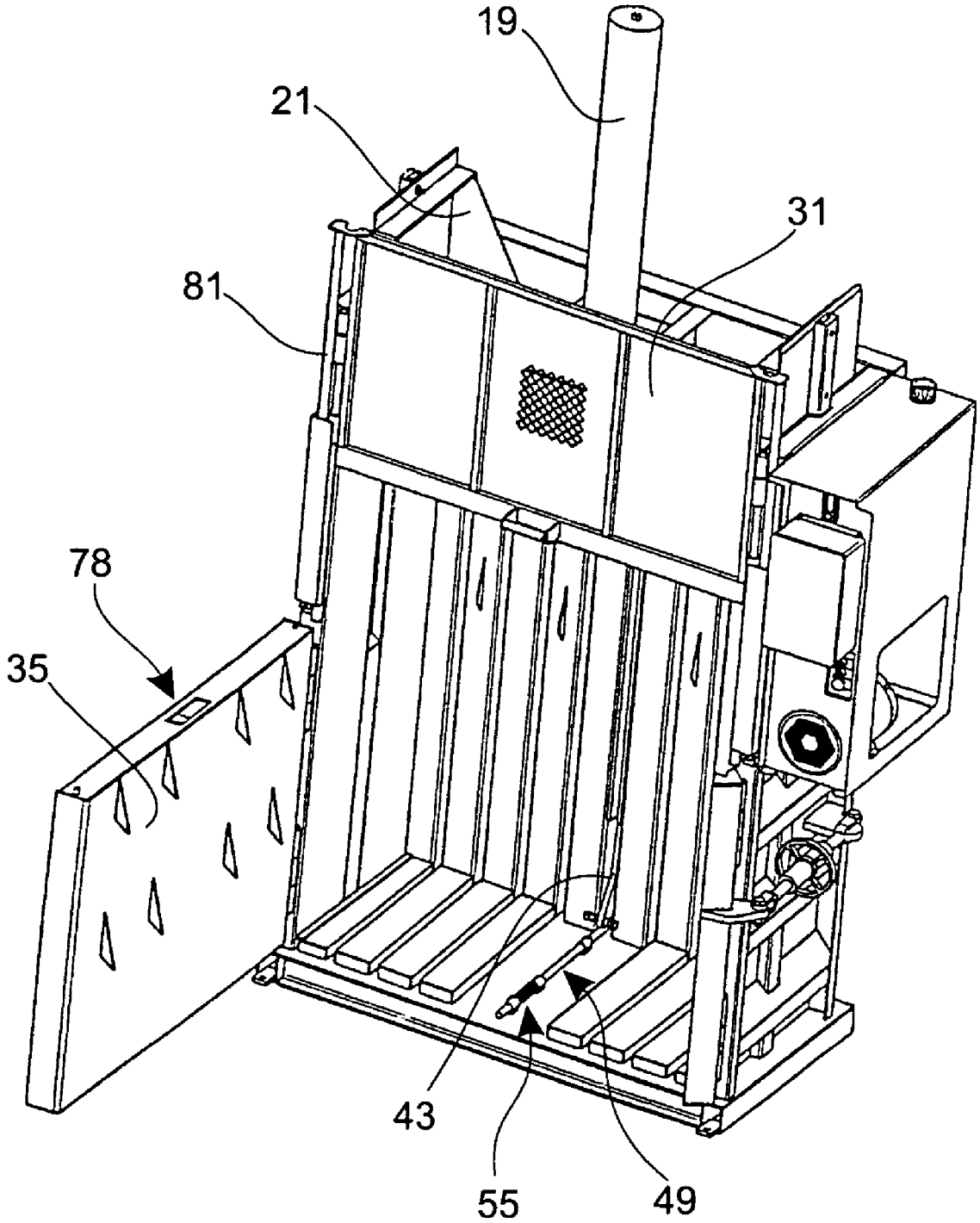
FIG. 2 is an isometric view of the apparatus of FIG. 1 broken away to show functional elements thereof.
Figure 4A:
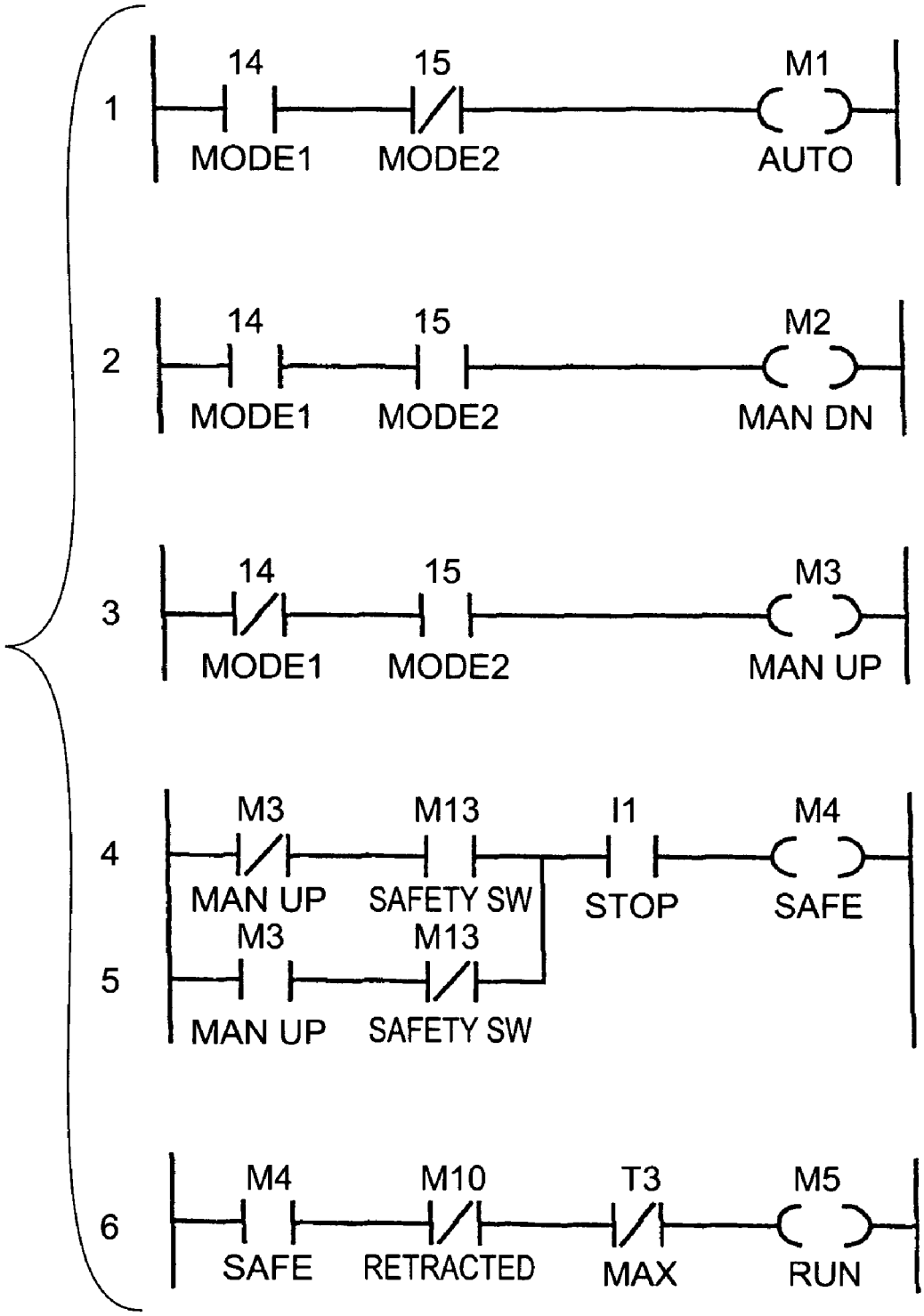
FIGS. 4A through 4E is a diagram of one embodiment of programmable relay configuration for controlling the baler of FIGS. 1 and 2.
Figure 4B:
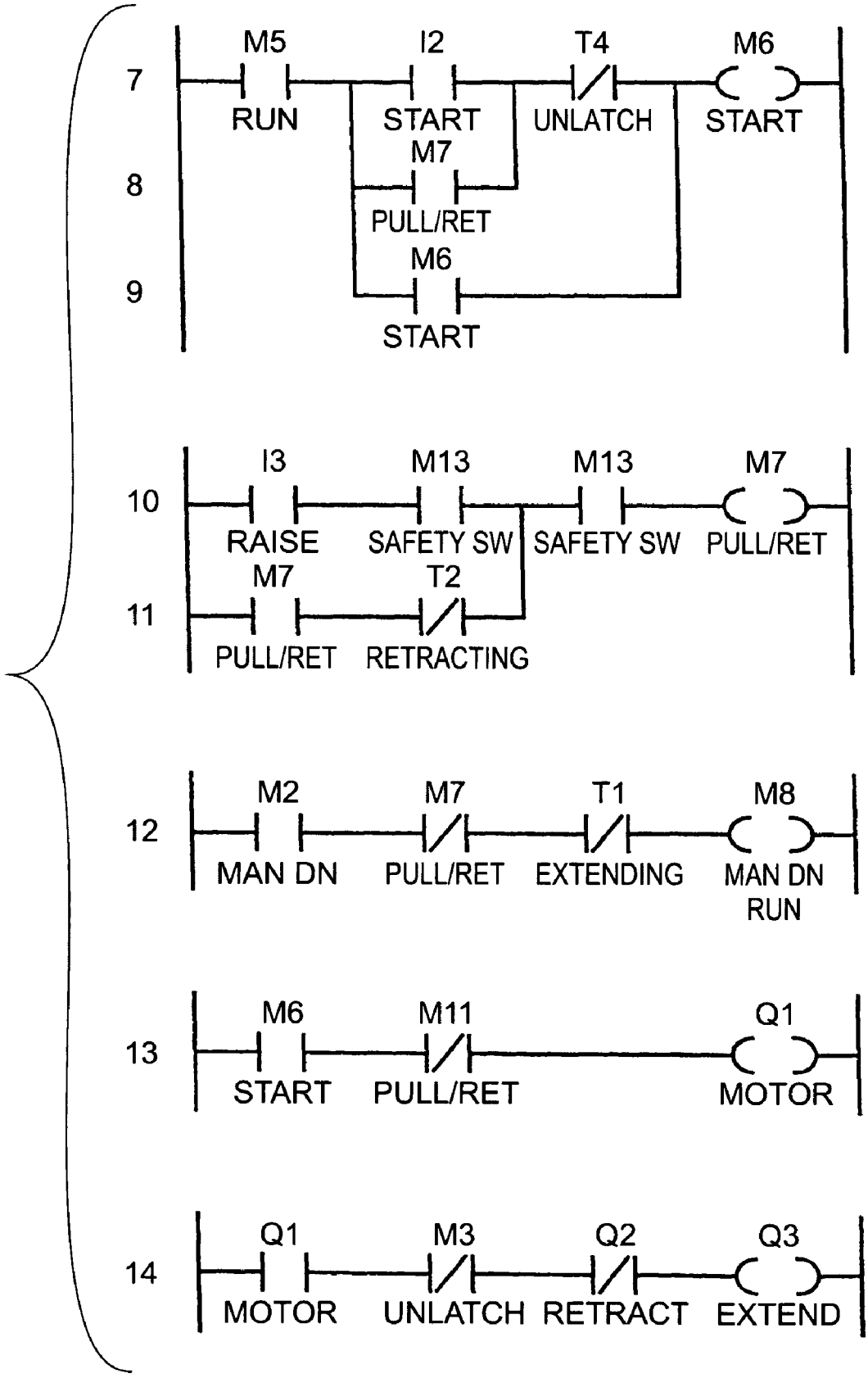
Figure 4C:
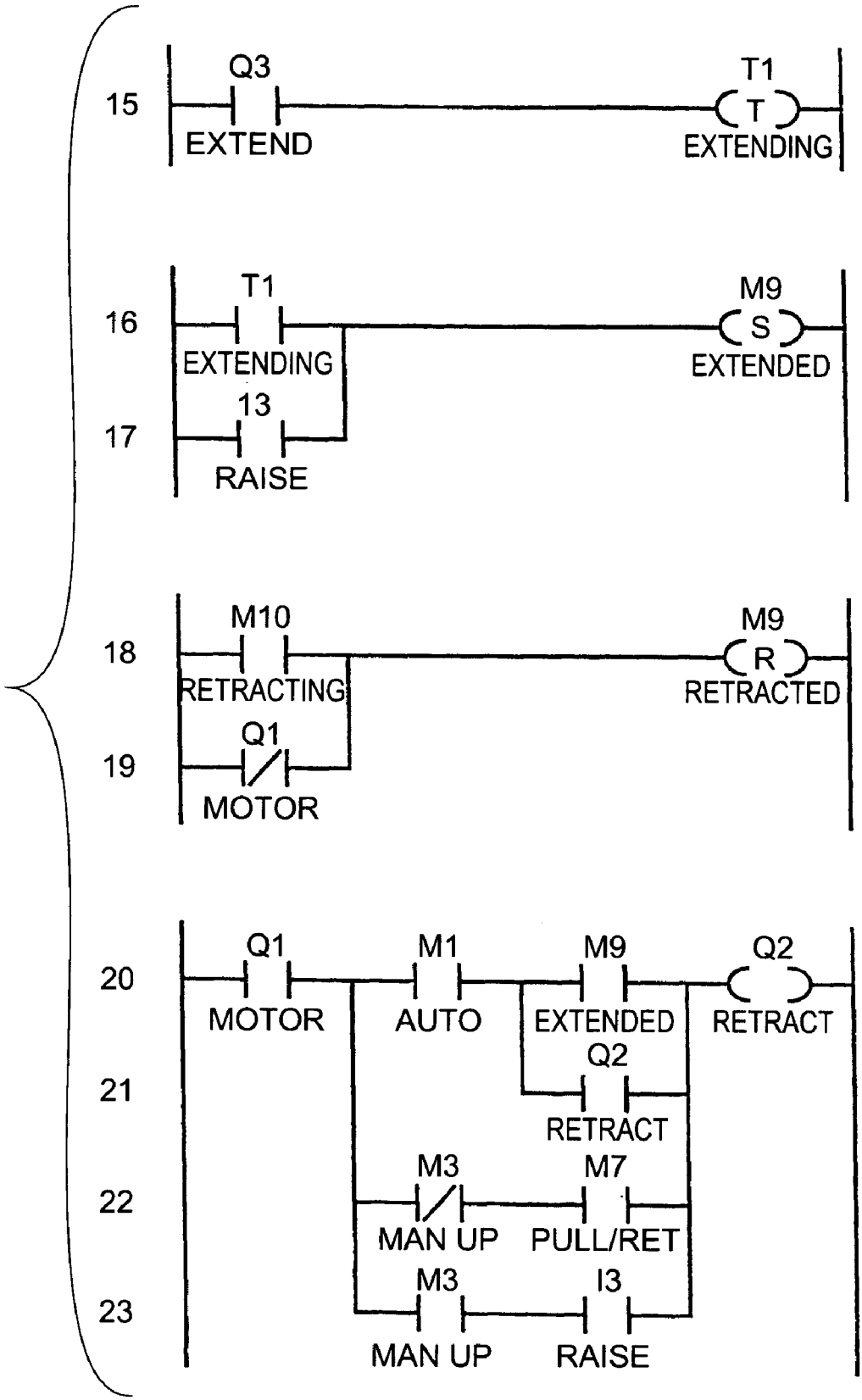
Figure 4D:
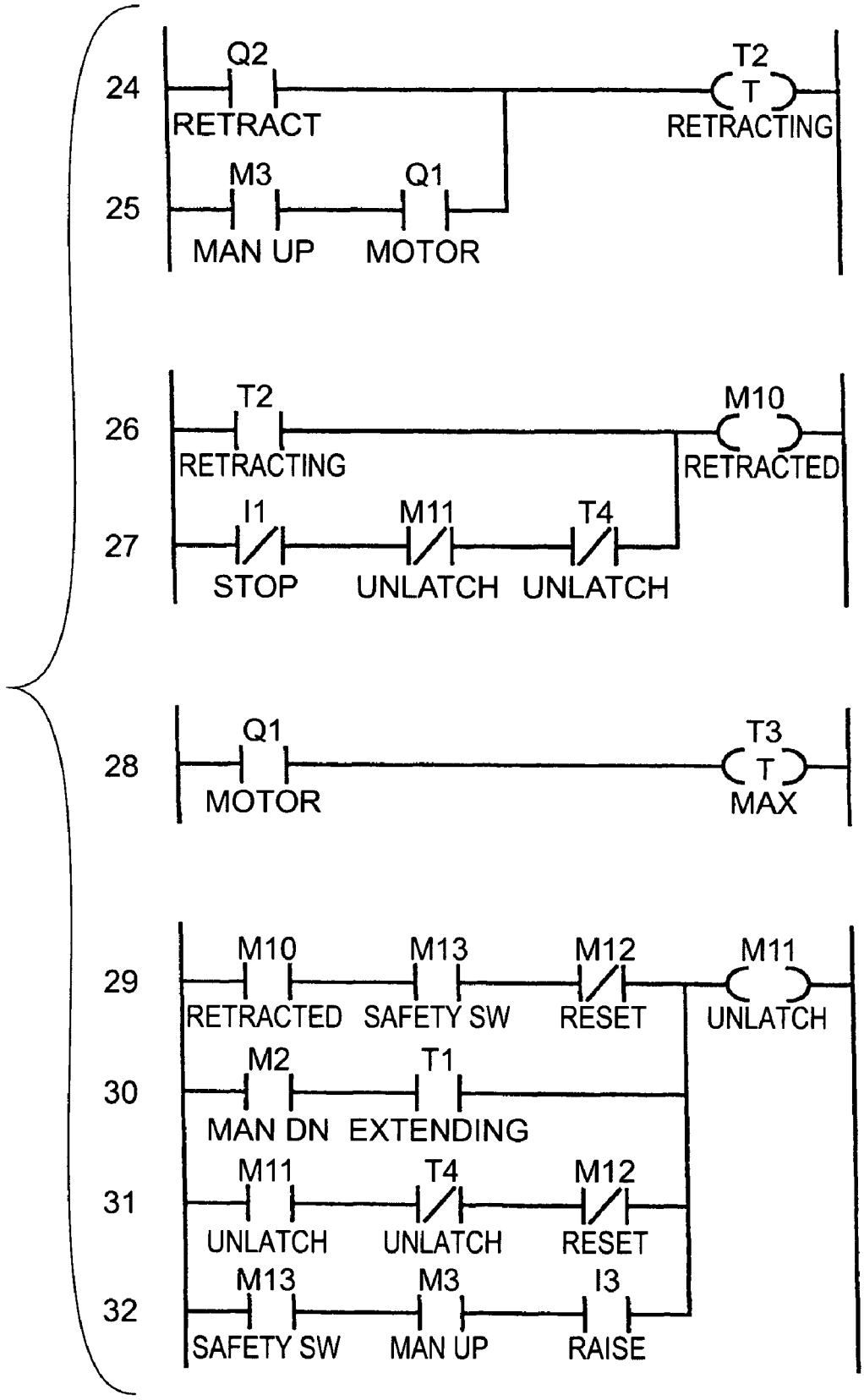
Figure 4E:
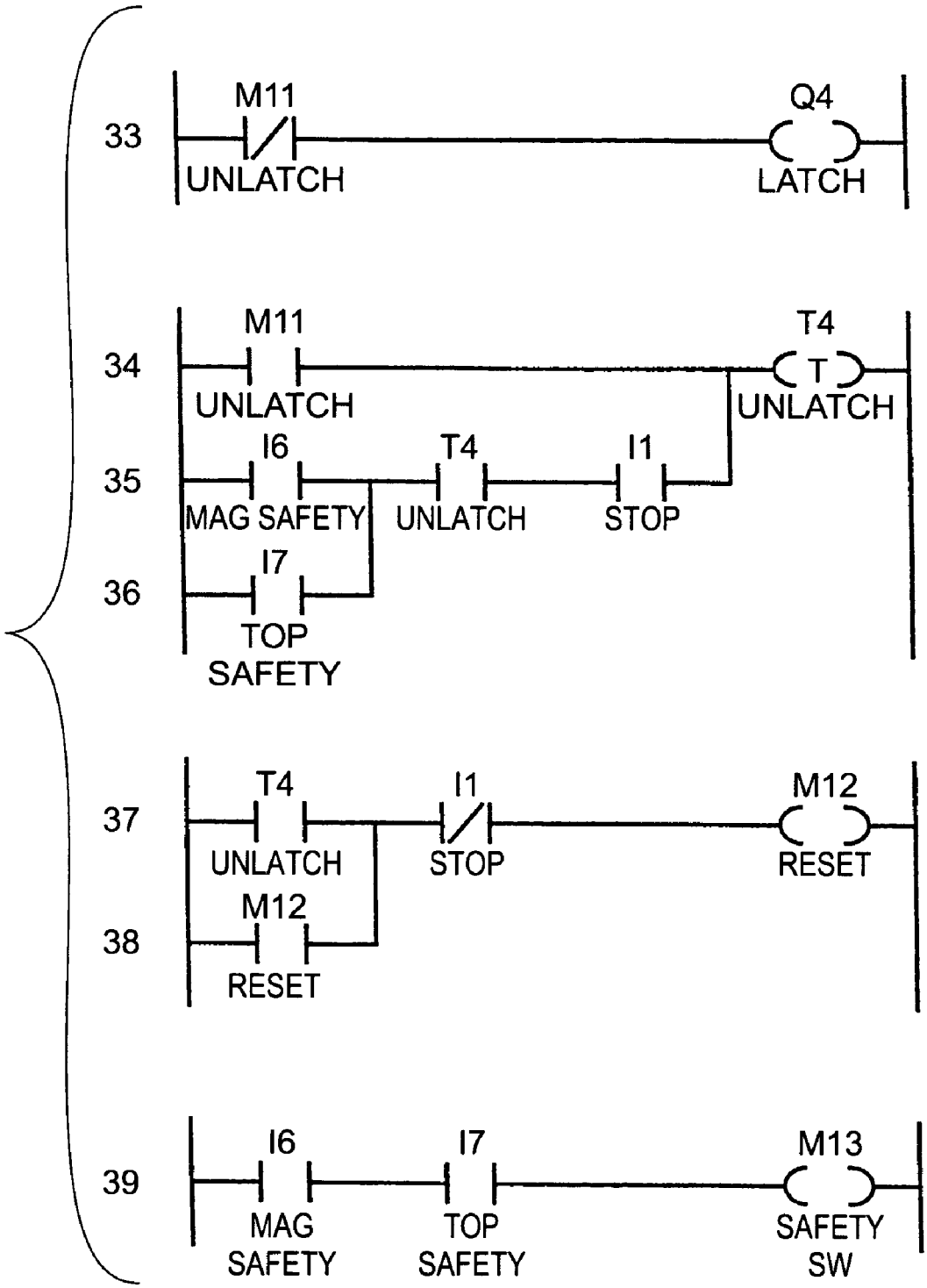

Referring to FIGS. 1, 2, and 3, a baler 11 according to the invention is shown having a bale chamber 13 to receive waste which is to be compacted. Hydraulic ram 19 of conventional construction serves to raise and lower a platen 21 to provide the compressing force on the waste material for compaction. A loading door 31 slides in vertical tracks to provide a closeable opening for loading waste into the chamber 13. In FIG. 1, door 31 is broken away to show the structure behind it but door 31 is shown in its entirety in FIG. 2.

Figure 7:
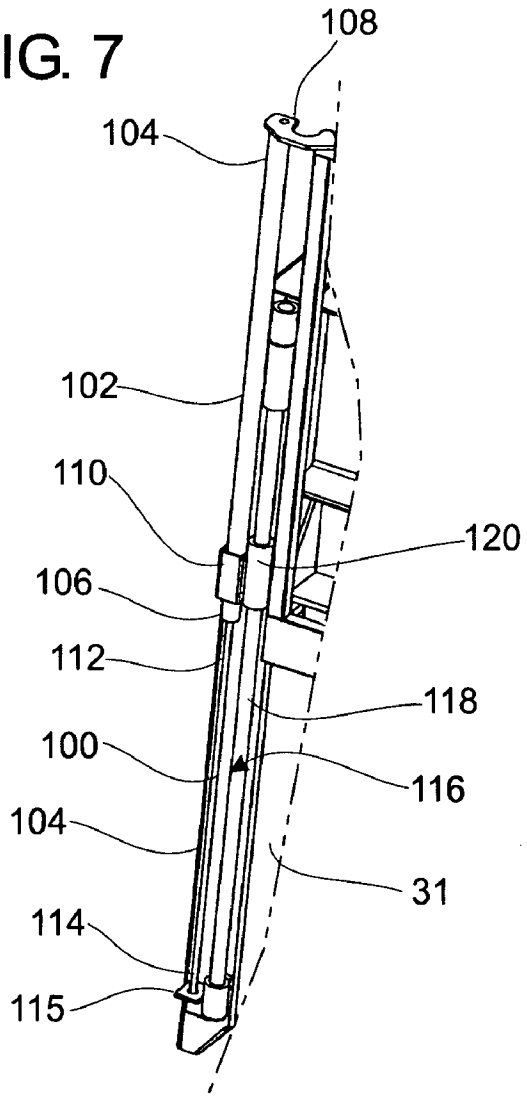
FIG. 7 is a magnified view of the Detail A area shown in FIG. 6.
Figure 6:
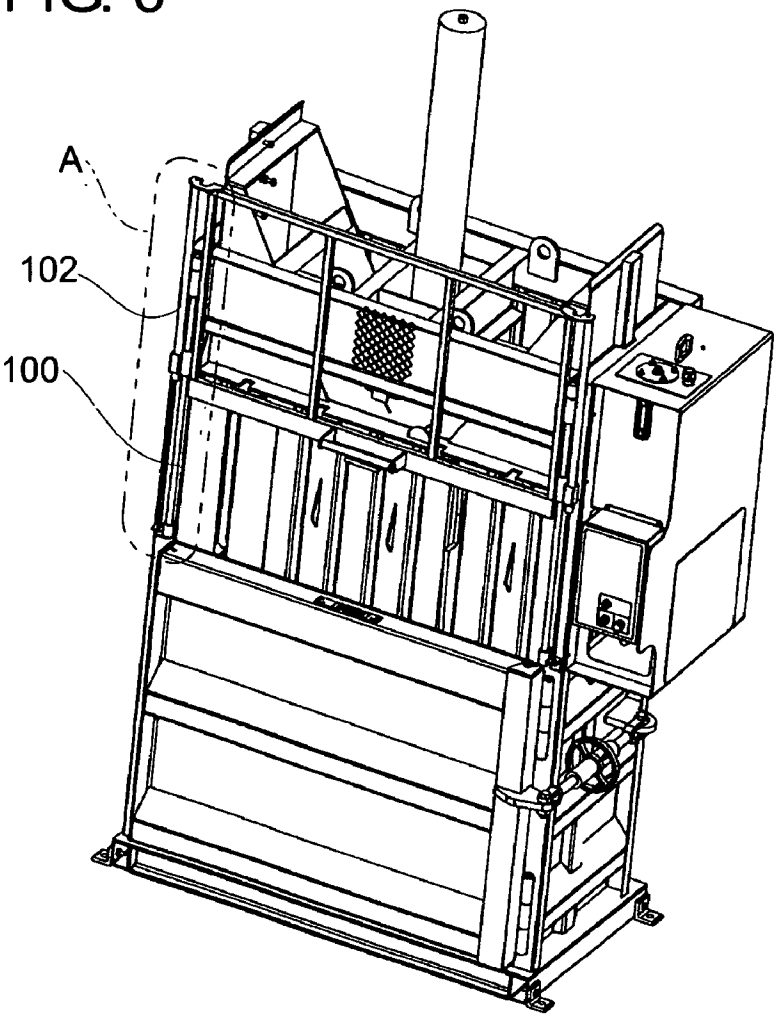
FIG. 6 is an isometric view of a baler according to the present invention defining the detail A.

As shown in FIGS. 6 and 7, in one preferred embodiment, the loading door 31 is not provided with a conventional counterweight and cable mechanism, but is rather provided with gas springs 81 of conventional form mounted on each side of the loading door 31. Gas spring 81 is a readily available component, used extensively in the automotive industry for hoods and rear cargo doors on vans and sport utility vehicles.

The detail of the gas spring 81 mounting may be seen in FIGS. 6 and 7. The loading door 31 is mounted on vertical slides 116 consisting of guide bearings 120 attached to the door 31 that slide on vertical guide rods 118 mounted to the frame 104. The gas spring 81 includes an extending rod 100 and an outer rod casing 102. The first casing end 104 is connected to the door by door bracket 108 and the second casing end 106 of the outer rod casing 102 is retained to the frame 104 by means of frame retention bracket 110.

The extending rod 100 includes a first rod end 112 and a second rod end 114. The first rod end 112 travels inside the outer rod casing 102 as is known in convention gas springs 81. The second rod end 114 of the gas spring 81 is connected to the frame 104 by frame bracket 115. The gas spring 81 is provided with a vertically protected area by its positioning on the outside of the door slides 116 so that items inserted into the compactor will not directly impact the springs 81.

Each gas spring 81 is chosen for characteristics appropriate to overcome the weight of the door 31 to raise the door 31 to the upward position at any time when the door 31 is not engaged by interlock 78. One of the main advantages of the gas spring 81 is the ability to control the end travel movement of the loading door 31 and to eliminate the harsh impact that an undamped system provides due to the inertia of the moving door 31. The preferred gas springs 81 are partially damped gas springs 81 configured with the loading door 31 of particular size and weight so that when the door 31 is released from the electromagnetic interlock 78, the door 31 will raise at moderate speed smoothly and softly upward to its fully opened position. These damping features are preferably active over at least a portion of the travel of the gas spring 81. Only moderate damping is needed in the spring 81 for one to five inches of travel prior to the extended position. The damping features should be active over at least one inch of the travel preceding full compression. Preferably, the extent of damping of travel is less than five inches.

Smooth, quiet operation and easy manual pull down is attained by the relation of gas spring 81 characteristics. The door 31 had an associated weight and the corresponding lifting forces of each gas spring 81 can range from a minimum to a maximum. For example, with a typical loading door 31 weighing 55 pounds, each spring 81 force is preferably about 45 pounds each at compression to provide a force of 164 percent of the weight of the door 31 (45×2/55). Springs with a 45 pound maximum force will have a minimum force of approximately 40 pounds each. Thus, these springs provide a minimum gas spring force as a percentage of door weight of about 145 percent (40×2/55). Thus, the gas springs 81 may be chosen using these types of characteristics. In this manner, a pair of gas springs 81 is configured with the loading door 31 to apply an upward force sufficient to raise the loading door 31 to its uppermost position.

While the gas spring 81 arrangement for the loading door 31 is a very desirable feature, the system would be fully operative with some other damped or undamped counterweight or spring arrangement as known in the art.

Unloading opening 33 at the front of the baler 11 is closed by a chamber door 35 having a lock 36. It is opened when it is desired to access a bale for tying and/or for ejecting it. A dump tray 41 in the bottom of the baler chamber is pivoted at its front edge and allowed to rotate up and forwardly to cause ejection of a finished bale. In the center of back 17 of the baler 11 is a vertically extending dump link bar 43 permanently engaged to the platen 21 to move therewith and selectively engageable with the dump tray 41. In FIG. 2 the baler 11 is shown with the dump tray 41 broken away to show a dump control link 49 extending fore and aft at the bottom of the dump tray 41. Control link 49 causes the dump tray 41 to be engaged by the dump link bar 43 (but only when dump link bar 43 is allowed to assume a forward with door 35 not closed). Spring 55 on control link 49 serves to urge it forward except when door 35 is closed.

From the foregoing description, it will be seen that the dump tray 41 is inactive so long as door 35 is closed, but may be raised by the hydraulic ram to eject a bale due to being coupled to platen 21 when door 35 is open. Other known embodiments of bale ejection apparatus or as shown in prior patents could be employed with the control apparatus rather than using the preferred embodiment shown and described above.

An enlarged view of the preferred control panel arrangement for the apparatus is shown in FIG. 3. A mode selector switch for selecting manual up, manual down, and auto modes of operation is shown at 71. The function of this switch will be described more fully hereinafter. An off/on/start key switch 73 is positioned below the mode selector switch 71. A key switch is provided to give control over authorization to operate the baler. Other access control devices such as biometric controls and magnetic card readers could also be used for operator access control for the baler. Electrical operation of switch 73 is more fully explained below.

Below the key switch 73 is a stop/pull to raise button 75. In addition to serving as an emergency stop switch the stop/pull to raise button 75 serves as the control for manually raising the platen to eject a finished bale. It must be manually pulled out and held by an operator for that operation. This is a safety feature that will be further explained in connection with the control system for the baler. A power on light 89 in this preferred embodiment is associated with the mode selector switch 71 but this is an optional feature and a different form of power on light could be provided if desired. An alternative embodiment places a stop/pull to raise buttom 75 to the right of key switch 73.

Key switch 73, among other things, controls the motor 90 with motor starter 92 which provides power for hydraulic ram 19. The hydraulic system and valves therefore are conventional and their function will be understood by those skilled in the art so that the details thereof are not shown. In the interest of clarity, details of well known elements of balers and other compaction equipment are not shown and described.

The programmable controller for the baler 11 preferably takes the form of a programmable relay 61 (shown in FIG. 5) utilizing relay ladder logic as shown in FIGS. 4A through 4E. For an explanation of relay ladder logic processors refer to U.S. Pat. No. 5,777,869, issued Jul. 7, 1998 to Welch and U.S. Pat. No. 6,018,797, issued Jan. 25, 2000 to Schmidt, et al., incorporated herein by reference, and to the references cited in those patents. A very brief explanation of ladder logic processors will be helpful in describing FIGS. 4A through 4E. As seen in FIGS. 4A through 4E, ladder logic programming, as expected, looks like a ladder. It probably has more similarities to a flow chart than the usual multi-line computer program. There are two vertical lines coming down the program chart, one on the left and one on the right. "Rungs" between the lines have conditionals on the left that lead to outputs on the right as will be apparent in FIGS. 4A through 4E. The most used elements in ladder logic are the relay conditionals —| |— and —|/|— and the output coils —( )—. The relay conditional with a space means "closed only if energized" while the relay conditional with the slash means "closed if not energized." The output coil generally means "if its relay is closed energize this output element."

The delay timing notations and other notations in the ladder logic chart of FIG. 4A through E are self-explanatory. Ladder rung numbers appear at the left margin.

The operation of the baler control system will be explained first for the "AUTO" mode. The conditions for the initial set-up are:

Mode selector switch 71 is in the center position for "AUTO" mode;

Key switch 73 is in the center position for "POWER ON";

Stop button 75 is in the center position for normal operation;

Baler chamber door 35 is closed and latched;

Platen 21 is fully retracted;

Loading door 31 is open;

Electromagnetic interlock 78 is energized.

The software under which the ladder logic program runs operates in a scanning mode with a scan cycle on the order of ten milliseconds. The program status of the ladder logic program at set-up is as follows.

Set-up PROGRAM:

Rung 1, I4 closed, I5 closed, M1 energized
Rung 2, I4 open, I5 closed, M2 not energized
Rung 3, I4 closed, I5 open, M3 not energized
Rung 4, M3 closed, I8 open, I1 closed, M4 not energized
Rung 5, M3 open, I8 closed
Rung 6, M4 open, M10 closed, T3 closed, M5 not energized
Rung 7, M5 open, I2 open, T4 closed, M6 not energized
Rung 8, M7 open
Rung 9, M6 open, I7 open
Rung 10, M3 open
Rung 11, I3 open, I8 open, I7 open, M7 not energized
Rung 12, M7 open, I7 open
Rung 13, M6 open, M11 closed, Q1 not energized
Rung 14, Q1 open, M3 closed, Q4 closed, Q3 not energized
Rung 15, Q3 open, T1 not energized
Rung 16, T1 open, M9 (S) not energized
Rung 17, I3 open
Rung 18, M10 open, M9 (R) energized
Rung 19, Q1 closed
Rung 20, Q1 open, M1 closed, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 open
Rung 26, T2 open, M10 not energized
Rung 27, I7 closed, Q4 open, M3 closed
Rung 28, I1 open, M11 closed, T4 closed
Rung 29, Q1 open, T3 not energized
Rung 30, M10 open, I8 open, M12 closed, M11 not energized
Rung 31, M2 open, T1 open
Rung 32, M11 open, T4 closed, M12 closed
Rung 33, I8 open, M3 open, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open For transition to the initial operation mode, the loading door 31 is closed and when the striking plate 79 closes with the electromagnetic interlock 78 the loading door 31 locks. The status of the ladder logic program then becomes

AUTO READY OPERATION PROGRAM:

Rung 1, I4 closed, I5 closed, M1 energized
Rung 2, I4 open, I5 closed, M2 not energized
Rung 3, I4 closed, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 open, T4 closed, M6 not energized
Rung 8, M7 open
Rung 9, M6 open, I7 open
Rung 10, M3 open
Rung 11, I3 open, I8 closed, I7 open, M7 not energized
Rung 12, M7 open, I7 open
Rung 13, M6 open, M11 closed, Q1 not energized
Rung 14, Q1 open, M3 closed, Q4 closed, Q3 not energized
Rung 15, Q3 open, T1 not energized
Rung 16, T1 open, M9 (S) not energized
Rung 17, I3 open
Rung 18, M10 open, M9 (R) energized
Rung 19, Q1 closed
Rung 20, Q1 open, M1 closed, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 open
Rung 26, T2 open, M10 not energized
Rung 27, I7 closed, Q4 open, M3 closed
Rung 28, I1 open, M11 closed, T4 closed
Rung 29, Q1 open, T3 not energized
Rung 30, M10 open, I8 closed, M12 closed, M11 not energized
Rung 31, M2 open, T1 open
Rung 32, M11 open, T4 closed, M12 closed
Rung 33, I8 closed, M3 open, I3 open
Rung 34, M11 closed, Q2 energized
Rung 35, M11 open, T4 not energized
Rung 36, I8 closed, T4 open, I1 closed
Rung 37, I7 open
Rung 38, T4 open, I1 open, M12 not energized
Rung 39, M12 open For start operation, the key switch is turned to the right to the "START" position causing the motor powering the hydraulic ram 19 to start and the platen 21 to begin its descent. The ladder logic program status then becomes

AUTO START OPERATION PROGRAM:

Rung 1, I4 closed, I5 closed, M1 energized
Rung 2, I4 open, I5 closed, M2 not energized
Rung 3, I4 closed, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 closed, T4 closed, M6 energized
Rung 8, M7 open
Rung 9, M6 closed, I7 open
Rung 10, M3 open
Rung 11, I3 open, I8 closed, I7 open, M7 not energized
Rung 12, M7 open, I7 open
Rung 13, M6 closed, M11 closed, Q1 energized
Rung 14, Q1 closed, M3 closed, Q4 closed, Q3 energized
Rung 15, Q3 closed, T1 energized (timing)
Rung 16, T1 open, M9 (S) not energized
Rung 17, I3 open
Rung 18, M10 open, M9 (R) not energized
Rung 19, Q1 open
Rung 20, Q1 closed, M1 closed, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 closed
Rung 26, T2 open, M10 not energized
Rung 27, I7 open, Q4 open, M3 closed
Rung 28, I1 open, M 11 closed, T4 closed
Rung 29, Q1 closed, T3 energized (timing)
Rung 30, M10 open, I8 closed, M12 closed, M11 not energized
Rung 31, M2 open, T1 open
Rung 32, M11 open, T4 closed, M12 closed
Rung 33, I8 closed, M3 open, I3 open
Rung 34, M11 closed, Q2 energized
Rung 35, M11 open, T4 not energized
Rung 36, I8 closed, T4 open, I1 closed
Rung 37, I7 open
Rung 38, T4 open, I1 open, M12 not energized
Rung 39, M12 open In the descending operation the safety interlock switch 78 will close as the platen 21 descends about three inches and the key switch 73 should by then be released to return to the center or "POWER ON" position. The status in descent operation is:

DESCENT OPERATION PROGRAM:

Rung 1, I4 closed, I5 closed, M1 energized
Rung 2, I4 open, I5 closed, M2 not energized
Rung 3, I4 closed, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 open, T4 closed, M6 energized
Rung 8, M7 open
Rung 9, M6 closed, I7 closed
Rung 10, M3 open
Rung 11, I3 open, I8 closed, I7 closed, M7 not energized
Rung 12, M7 open, I7 closed
Rung 13, M6 closed, M11 closed, Q1 energized
Rung 14, Q1 closed, M3 closed, Q4 closed, Q3 energized
Rung 15, Q3 closed, T1 energized (timing)
Rung 16, T 1 open, M9 (S) not energized
Rung 17, I3 open
Rung 18, M10 open, M9 (R) not energized
Rung 19, Q1 open
Rung 20, Q1 closed, M1 closed, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 closed
Rung 26, T2 open, M10 not energized
Rung 27, I7 open, Q4 open, M3 closed
Rung 28, I1 open, M11 closed, T4 closed
Rung 29, Q1 closed, T3 energized (timing)
Rung 30, M10 open, I8 closed, M12 closed, M11 not energized
Rung 31, M2 open, T1 open
Rung 32, M11 open, T4 closed, M12 closed
Rung 33, I8 closed, M3 open, I3 open
Rung 34, M11 closed, Q2 energized
Rung 35, M11 open, T4 not energized
Rung 36, I8 closed, T4 open, I1 closed Rung 37, I7 closed
Rung 38, T4 open, I1 open, M12 not energized
Rung 39, M12 open The platen 21 will continue to be in the descend mode until the accumulated extend time is equal to the preset value of the extend timer, at which time the platen 21 will start retracting. Since this operation is a matter of timing only, the time during which the force of the platen is applied to compact the trash may vary somewhat. The ladder logic program status for retract operation is:

RETRACT OPERATION PROGRAM:
Rung 1, I4 closed, I5 closed, M1 energized
Rung 2, I4 open, I5 closed, M2 not energized
Rung 3, I4 closed, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 open, T4 closed, M6 energized
Rung 8, M7 open
Rung 9, M6 closed, I7 closed
Rung 10, M3 open
Rung 11, I3 open, I8 closed, I7 closed, M7 not energized
Rung 12, M7 open, I7 closed
Rung 13, M6 closed, M11 closed, Q1 energized
Rung 14, Q1 closed, M3 closed, Q4 open, Q3 not energized
Rung 15, Q3 open, T1 (timed out) (not energized)
Rung 16, T1 closed, M9 (S) energized, T1 returns to open, M9 (S) not energized
Rung 17, I3 open
Rung 18, M10 open, M9 (R) not energized
Rung 19, Q1 open
Rung 20, Q1 closed, M1 closed, M9 closed, Q4 energized
Rung 21, Q4 closed
Rung 22, M3 closed, M7 open
Rung 23, M3 open, I3 open
Rung 24, Q4 closed, T2 energized (timing)
Rung 25, M3 open, Q1 closed
Rung 26, T2 open, M10 not energized
Rung 27, I7 open, Q4 closed, M3 closed
Rung 28, I1 open, M11 closed, T4 closed
Rung 29, Q1 closed, T3 energized (timing)
Rung 30, M10 open, I8 closed, M12 closed, M11 not energized
Rung 31, M2 open, T1 closed, T1 returns to open
Rung 32, M11 open, T4 closed, M12 closed
Rung 33, I8 closed, M3 open, I3 open
Rung 34, M11 closed, Q2 energized
Rung 35, M11 open, T4 not energized
Rung 36, I8 closed, T4 open, I1 closed
Rung 37, I7 closed
Rung 38, T4 open, I1 open, M12 not energized
Rung 39, M12 open The platen 21 will retract until it moves to open the safety interlock 78 or when the accumulated retract time is equal to the preset value in the retract timer. In either case, the motor powering the ram 19 will stop and the electromagnetic interlock 78 will de-energize for three seconds to unlock the loading door 31 allowing it to open. The ladder logic program status is as follows:

RETRACT OPERATION PROGRAM:
Rung 1, I4 closed, I5 closed, M1 energized
Rung 2, I4 open, I5 closed, M2 not energized
Rung 3, I4 closed, I5 open, M3 not energized
Rung 4, M3 closed, I8 closed, I1 closed, M4 energized
Rung 5, M3 open, I8 open
Rung 6, M4 closed, M10 open, T3 closed, M5 not energized, M10 returns to closed, M5 energized
Rung 7, M5 open, I2 open, T4 closed, M6 not energized, M5 returns to closed
Rung 8, M7 open
Rung 9, M6 open, I7 open
Rung 10, M3 open
Rung 11, I3 open, I8 closed, I7 open, M7 not energized
Rung 12, M7 open, I7 open
Rung 13, M6 open, M11 open, Q1 not energized
Rung 14, Q1 open, M3 closed, Q4 closed, Q3 not energized
Rung 15, Q3 open, T1 not energized
Rung 16, T1 open, M9 (S) not energized
Rung 17, I3 open
Rung 18, M10 closed, M9 (R) energized, M10 returns to open
Rung 19, Q1 closed
Rung 20, Q1 open, M1 closed, M9 open, Q4 not energized
Rung 21, Q4 open
Rung 22, M3 closed, M7 open
Rung 23, M3 open, I3 open
Rung 24, Q4 open, T2 not energized (timed out)
Rung 25, M3 open, Q1 open
Rung 26, T2 closed, M10 energized, T2 returns to open, M10 not energized
Rung 27, I7 closed, Q4 open, M3 closed
Rung 28, I1 open, M11 open, T4 closed
Rung 29, Q1 open, T3 not energized
Rung 30, M10 closed, I8 closed, M12 closed, M11 energized, M10 returns to open
Rung 31, M2 open, T1 open
Rung 32, M11 closed, T4 closed, M12 closed
Rung 33, I8 closed, M3 open, I3 open
Rung 34, M11 open, Q2 not energized
Rung 35, M11 closed, T4 energized (timing)
Rung 36, I8 closed, T4 open, I1 closed
Rung 37, I7 open
Rung 38, T4 open, I1 open, M12 not energized
Rung 39, M12 open After the loading door opening mechanism opens the loading door 31, the electromagnetic interlock 78 will re-energize. The ladder logic program status will be:

END OPERATION MODE PROGRAM:
Rung 1, I4 closed, I5 closed, M1 energized
Rung 2, I4 open, I5 closed, M2 not energized
Rung 3, I4 closed, I5 open, M3 not energized
Rung 4, M3 closed, I8 open, I1 closed, M4 not energized
Rung 5, M3 open, I8 closed
Rung 6, M4 open, M10 closed, T3 closed, M5 not energized
Rung 7, M5 open, I2 open, T4 closed, M6 not energized
Rung 8, M7 open
Rung 9, M6 open, I7 open
Rung 10, M3 open
Rung 11, I3 open, I8 open, I7 open, M7 not energized
Rung 12, M7 open, I7 open
Rung 13, M6 open, M11 closed, Q1 not energized
Rung 14, Q1 open, M3 closed, Q4 closed, Q3 not energized
Rung 15, Q3 open, T1 not energized
Rung 16, T1 open, M9 (S) not energized
Rung 17, I3 open
Rung 18, M10 open, M9 (R) energized
Rung 19, Q1 closed
Rung 20, Q1 open, M1 closed, M9 open, Q4 not energized Rung 21, Q4 open
Rung 22, M3 closed, M7 open
Rung 23, M3 open, I3 open
Rung 24, Q4 open, T2 not energized
Rung 25, M3 open, Q1 open
Rung 26, T2 open, M10 not energized
Rung 27, I7 closed, Q4 open, M3 closed
Rung 28, I1 open, M11 open, T4 closed, M11 returns to closed
Rung 29, Q1 open, T3 not energized
Rung 30, M10 open, I8 open, M12 closed, M11 not energized
Rung 31, M2 open, T1 open
Rung 32, M11 open, T4 open, M12 closed, T4 returns to closed
Rung 33, I8 open, M3 open, I3 open
Rung 34, M11 closed, Q2 energized
Rung 35, M11 open, T4 not energized (timed out)
Rung 36, I8 open, T4 closed, I1 closed, T4 returns to open
Rung 37, I7 open
Rung 38, T4 closed, I1 open, M12 not energized, T4 returns to open
Rung 39, M12 open The "AUTO" operation described above is that which would be used in accumulating waste and compacting it in a series of operations to form a bale.

The "MANUAL DOWN" mode of operation described below is used when such is desired, particularly when sufficient waste has been accumulated and compacted to form a bale, so that it can be removed from the baler. The set-up conditions for the "MANUAL DOWN" mode of operation are as follows:

Mode selector switch 71 is in the 60 degree down position for "MANUAL DOWN" mode.

The key switch is in the center position for "POWER ON".

The stop button 75 is in the center position for normal operation.

The baler chamber door 35 is closed and latched.

The platen 21 is fully retracted.

The loading door 31 is open.

The electromagnetic interlock 78 is energized.

The set-up status for the ladder logic program is

MANUAL DOWN SETUP PROGRAM:
Rung 1, I4 open, I5 closed, M1 not energized
Rung 2, I4 closed, I5 closed, M2 energized
Rung 3, I4 open, I5 open, M3 not energized
Rung 4, M3 closed, I8 open, I1 closed, M4 not energized
Rung 5, M3 open, I8 closed
Rung 6, M4 open, M10 closed, T3 closed, M5 not energized
Rung 7, M5 open, I2 open, T4 closed, M6 not energized
Rung 8, M7 open
Rung 9, M6 open, I7 open
Rung 10, M3 open
Rung 11, I3 open, I8 open, I7 open, M7 not energized
Rung 12, M7 open, I7 open
Rung 13, M6 open, M11 closed, Q1 not energized
Rung 14, Q1 open, M3 closed, Q4 closed, Q3 not energized
Rung 15, Q3 open, T1 not energized
Rung 16, T1 open, M9 (S) not energized
Rung 17, I3 open
Rung 18, M10 open, M9 (R) energized
Rung 19, Q1 closed
Rung 20, Q1 open, M1 open, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 open
Rung 26, T2 open, M10 not energized
Rung 27, I7 closed, Q4 open, M3 closed
Rung 28, I1 open, M11 closed, T4 closed
Rung 29, Q1 open, T3 not energized
Rung 30, M10 open, I8 open, M12 closed, M11 not energized
Rung 31, M2 closed, T1 open
Rung 32, M11 open, T4 closed, M12 closed
Rung 33, I8 open, M3 open, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open Preliminary to starting the MANUAL DOWN operation, the loading door 31 is closed. When striking plate 79 closes with the electromagnetic interlock 78, the loading door 31 locks. The ladder logic program status is START MANUAL DOWN PROGRAM:
Rung 1, I4 open, I5 closed, M1 not energized
Rung 2, I4 closed, I5 closed, M2 energized
Rung 3, I4 open, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 open, T4 closed, M6 not energized
Rung 8, M7 open
Rung 9, M6 open, I7 open
Rung 10, M3 open
Rung 11, I3 open, I8 open, I7 open, M7 not energized
Rung 12, M7 open, I7 open
Rung 13, M6 open, M11 closed, Q1 not energized
Rung 14, Q1 open, M3 closed, Q4 closed, Q3 not energized
Rung 15, Q3 open, T1 not energized
Rung 16, T1 open, M9 (S) not energized
Rung 17, I3 open
Rung 18, M10 open, M9 (R) energized
Rung 19, Q1 closed
Rung 20, Q1 open, M1 open, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 open
Rung 26, T2 open, M10 not energized
Rung 27, I7 closed, Q4 open, M3 closed
Rung 28, I1 open, M11 closed, T4 closed
Rung 29, Q1 open, T3 not energized
Rung 30, M10 open, I8 closed, M12 closed, M11 not energized
Rung 31, M2 closed, T1 open
Rung 32, M11 open, T4 closed, M12 closed
Rung 33, I8 closed, M3 open, I3 open
Rung 34, M11 closed, Q2 energized
Rung 35, M11 open, T4 not energized
Rung 36, I8 closed, T4 open, I1 closed
Rung 37, I7 open
Rung 38, T4 open, I1 open, M12 not energized
Rung 39, M12 open For MANUAL DOWN START operation, the key switch 73 is turned to the right to the "START" position causing the motor powering the hydraulic ram 19 to start and the platen 21 to begin its descent. The ladder logic program status then becomes:

START MANUAL DOWN OPERATION PROGRAM:

Rung 1, I4 open, I5 closed, M1 not energized
Rung 2, I4 closed, I5 closed, M2 energized
Rung 3, I4 open, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 closed, T4 closed, M6 energized
Rung 8, M7 open
Rung 9, M6 closed, I7 open
Rung 10, M3 open
Rung 11, I3 open, I8 closed, I7 open, M7 not energized
Rung 12, M7 open, I7 open
Rung 13, M6 closed, M11 closed, Q1 energized
Rung 14, Q1 closed, M3 closed, Q4 closed, Q3 energized
Rung 15, Q3 closed, T1 energized (timing)
Rung 16, T1 open, M9 (S) not energized
Rung 17, I3 open
Rung 18, M10 open, M9 (R) not energized
Rung 19, Q1 open
Rung 20, Q1 closed, M1 open, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 closed
Rung 26, T2 open, M10 not energized
Rung 27, I7 closed, Q4 open, M3 closed
Rung 28, I1 open, M11 closed, T4 closed
Rung 29, Q1 closed, T3 energized (timing)
Rung 30, M10 open, I8 closed, M12 closed, M11 not energized
Rung 31, M2 closed, T1 open
Rung 32, M11 open, T4 closed, M12 closed
Rung 33, I8 closed, M3 open, I3 open
Rung 34, M11 closed, Q2 energized
Rung 35, M11 open, T4 not energized
Rung 36, I8 closed, T4 open, I1 closed
Rung 37, I7 open
Rung 38, T4 open, I1 open, M12 not energized
Rung 39, M12 open In the descending operation, the safety interlocks switch 78 will close as the platen 21 descends about three inches and the key switch 73 should by then be released to return to the center or "POWER ON" position. The status in descent operation is

DESCENT OPERATION PROGRAM:

Rung 1, I4 open, I5 closed, M1 not energized
Rung 2, I4 closed, I5 closed, M2 energized
Rung 3, I4 open, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 open, T4 closed, M6 energized
Rung 8, M7 open
Rung 9, M6 closed, I7 closed
Rung 10, M3 open
Rung 11, I3 open, I8 closed, I7 closed, M7 not energized
Rung 12, M7 open, I7 closed
Rung 13, M6 closed, M11 closed, Q1 energized
Rung 14, Q1 closed, M3 closed, Q4 closed, Q3 energized
Rung 15, Q3 closed, T1 energized (timing)
Rung 16, T1 open, M9 (S) not energized
Rung 17, I3 open
Rung 18, M10 open, M9 (R) not energized
Rung 19, Q1 open
Rung 20, Q1 closed, M1 open, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 closed
Rung 26, T2 open, M10 not energized
Rung 27, I7 open, Q4 open, M3 closed
Rung 28, I1 open, M11 closed, T4 closed
Rung 29, Q1 closed, T3 energized (timing)
Rung 30, M10 open, I8 closed, M12 closed, M11 not energized
Rung 31, M2 closed, T1 open
Rung 32, M11 open, T4 closed, M12 closed
Rung 33, I8 closed, M3 open, I3 open
Rung 34, M11 closed, Q2 energized
Rung 35, M11 open, T4 not energized
Rung 36, I8 closed, T4 open, I1 closed
Rung 37, I7 closed
Rung 38, T4 open, I1 open, M12 not energized
Rung 39, M12 open The platen 21 will continue to be in the descent mode until its accumulated extend time is equal to the pre-set value of the extended value at which time the motor powering the ram 19 will stop and the electromagnetic interlock 78 will de-energize to unlock the loading door 31 for three seconds. The ladder logic program for this portion is

COMPLETE MANUAL DESCENT OPERATION PROGRAM:

Rung 1, I4 open, I5 closed, M1 not energized
Rung 2, I4 closed, I5 closed, M2 energized
Rung 3, I4 open, I5 open, M3 not energized
Rung 4, M3 closed, I8 closed, I1 closed, M4 energized
Rung 5, M3 open, I8 open
Rung 6, M4 closed, M10 closed, T3 closed, M5 energized
Rung 7, M5 closed, I2 open, T4 closed, M6 energized
Rung 8, M7 open
Rung 9, M6 closed, I7 closed
Rung 10, M3 open
Rung 11, I3 open, I8 closed, I7 closed, M7 not energized
Rung 12, M7 open, I7 closed
Rung 13, M6 closed, M11 open, Q1 not energized
Rung 14, Q1 open, M3 closed, Q4 closed, Q3 not energized
Rung 15, Q3 closed, T1 energized (timed out), Q3 opens, T1 not energized
Rung 16, T1 closed, M9 (S) energized, T1 returns to open, M9 (S) not energized
Rung 17, I3 open
Rung 18, M10 open, M9 (R) energized
Rung 19, Q1 closed
Rung 20, Q1 open, M1 open, M9 closed, Q4 not energized, M9 returns to open
Rung 21, Q4 open
Rung 22, M3 closed, M7 open
Rung 23, M3 open, I3 open
Rung 24, Q4 open, T2 not energized
Rung 25, M3 open, Q1 open
Rung 26, T2 open, M10 not energized
Rung 27, I7 open, Q4 open, M3 closed
Rung 28, I1 open, M11 open, T4 closed Rung 29, Q1 open, T3 not energized
Rung 30, M10 open, I8 closed, M12 closed, M11 energized
Rung 31, M2 closed, T1 closed, T1 returns to open
Rung 32, M11 closed, T4 closed, M12 closed
Rung 33, I8 closed, M3 open, I3 open
Rung 34, M11 open, Q2 not energized
Rung 35, M11 closed, T4 energized (timing)
Rung 36, I8 closed, T4 open, I1 closed
Rung 37, I7 closed
Rung 38, T4 open, I1 open, M12 not energized
Rung 39, M12 open Loading door opening mechanism opens the loading door 31 and after three seconds, the electromagnetic interlock 78 will re-energize. The status preparatory to opening the chamber door to tie the finished bale is as follows:

BEGIN MANUAL DOOR OPERATION
Rung 1, I4 open, I5 closed, M1 not energized
Rung 2, I4 closed, I5 closed, M2 energized
Rung 3, I4 open, I5 open, M3 not energized
Rung 4, M3 closed, I8 open, I1 closed, M4 not energized
Rung 5, M3 open, I8 closed
Rung 6, M4 open, M10 closed, T3 closed, M5 not energized
Rung 7, M5 open, I2 open, T4 closed, M6 not energized
Rung 8, M7 open
Rung 9, M6 open, I7 open
Rung 10, M3 open
Rung 11, I3 open, I8 open, I7 open, M7 not energized
Rung 12, M7 open, I7 open
Rung 13, M6 open, M11 closed, Q1 not energized
Rung 14, Q1 open, M3 closed, Q4 closed, Q3 not energized
Rung 15, Q3 open, T1 not energized
Rung 16, T1 open, M9 (S) not energized
Rung 17, I3 open
Rung 18, M10 open, M9 (R) energized
Rung 19, Q1 closed
Rung 20, Q1 open, M1 open, M9 open, Q4 not energized
Rung 21, Q4 open
Rung 22, M3 closed, M7 open
Rung 23, M3 open, I3 open
Rung 24, Q4 open, T2 not energized
Rung 25, M3 open, Q1 open
Rung 26, T2 open, M10 not energized
Rung 27, I7 closed, Q4 open, M3 closed
Rung 28, I1 open, M11 open, T4 closed, M11 returns to closed
Rung 29, Q1 open, T3 not energized
Rung 30, M10 open, I8 open, M12 closed, M11 not energized
Rung 31, M2 closed, T1 open
Rung 32, M11 open, T4 open, M12 closed, T4 returns to closed
Rung 33, I8 open, M3 open, I3 open
Rung 34, M11 closed, Q2 energized
Rung 35, M11 open, T4 not energized (timed out)
Rung 36, I8 open, T4 closed, I1 closed, T4 returns to open
Rung 37, I7 open
Rung 38, T4 closed, I1 open, M12 not energized, T4 returns to open
Rung 39, M12 open In preparation for removing a finished bale, the chamber door is opened and the finished bale is tied before instituting the "MANUAL UP" mode.

For operation of the baler control system in the "MANUAL UP" mode, the conditions for the initial set-up are:

Mode selector switch 71 is in the 60 degree UP position selecting "MANUAL UP".

The key switch 73 is in the center position for "POWER ON".

The stop button 75 is in the center position for normal operation.

The bale chamber door 35 is open and the finished bale is tied.

The platen 21 is extended to the top of the finished bale.

The loading door 31 is open.

The status of the ladder logic program then becomes:

MANUAL UP SET-UP PROGRAM
Rung 1, I4 closed, I5 open, M1 not energized
Rung 2, I4 open, I5 open, M2 not energized
Rung 3, I4 closed, I5 closed, M3 energized
Rung 4, M3 open, I8 open, I1 closed, M4 energized
Rung 5, M3 closed, I8 closed
Rung 6, M4 closed, M10 closed, T3 closed, M5 energized
Rung 7, M5 closed, I2 open, T4 closed, M6 not energized
Rung 8, M7 open
Rung 9, M6 open, I7 open
Rung 10, M3 closed
Rung 11, I3 open, I8 open, I7 open, M7 not energized
Rung 12, M7 open, I7 open
Rung 13, M6 open, M11 closed, Q1 not energized
Rung 14, Q1 open, M3 open, Q4 closed, Q3 not energized
Rung 15, Q3 open, T1 not energized
Rung 16, T1 open, M9 (S) not energized
Rung 17, I3 open
Rung 18, M10 open, M9 (R) energized
Rung 19, Q1 closed
Rung 20, Q1 open, M1 open, M9 open, Q4 not energized
Rung 21, Q4 open
Rung 22, M3 open, M7 open
Rung 23, M3 closed, I3 open
Rung 24, Q4 open, T2 not energized
Rung 25, M3 closed, Q1 open
Rung 26, T2 open, M10 not energized
Rung 27, I7 closed, Q4 open, M3 open
Rung 28, I1 open, M11 closed, T4 closed
Rung 29, Q1 open, T3 not energized
Rung 30, M10 open, I8 open, M12 closed, M11 not energized
Rung 31, M2 open, T1 open
Rung 32, M11 open, T4 closed, M12 closed
Rung 33, I8 open, M3 closed, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open The "MANUAL UP" operation, which also causes ejection apparatus (described elsewhere) to eject the finished bale from the baler, is initiated by the key switch 73 being turned to the right ("START") position. The motor starter 92 will then start the motor 90 but the platen 21 will not move. The status for the ladder logic program will be:

MANUAL UP STOP OPERATION PROGRAM
Rung 1, I4 closed, I5 open, M1 not energized
Rung 2, I4 open, I5 open, M2 not energized
Rung 3, I4 closed, I5 closed, M3 energized
Rung 4, M3 open, I8 open, I1 closed, M4 energized Rung 5, M3 closed, I8 closed
Rung 6, M4 closed, M10 closed, T3 closed, M5 energized
Rung 7, M5 closed, I2 closed, T4 closed, M6 energized
Rung 8, M7 open
Rung 9, M6 closed, I7 open
Rung 10, M3 closed
Rung 11, I3 open, I8 open, I7 open, M7 not energized
Rung 12, M7 open, I7 open
Rung 13, M6 closed, M11 closed, Q1 energized
Rung 14, Q1 closed, M3 open, Q4 closed, Q3 not energized
Rung 15, Q3 open, T1 not energized
Rung 16, T1 open, M9 (S) not energized
Rung 17, I3 open
Rung 18, M10 open, M9 (R) not energized
Rung 19, Q1 open
Rung 20, Q1 closed, M1 open, M9 open, Q4 not energized
Rung 21, Q4 open
Rung 22, M3 open, M7 open
Rung 23, M3 closed, I3 open
Rung 24, Q4 open, T2 energized (timing)
Rung 25, M3 closed, Q1 closed
Rung 26, T2 open, M10 not energized
Rung 27, I7 closed, Q4 open, M3 open
Rung 28, I1 open, M11 closed, T4 closed
Rung 29, Q1 closed, T3 energized (timing)
Rung 30, M10 open, I8 open, M12 closed, M11 not energized
Rung 31, M2 open, T1 open
Rung 32, M11 open, T4 closed, M12 closed
Rung 33, I8 open, M3 closed, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open When the key switch 73 is released to return to the center or "POWER ON" position, the controller is ready for manual raising of the platen and the status of the ladder logic program is:

MANUAL UP READY PROGRAM

Rung 1, I4 closed, I5 open, M1 not energized
Rung 2, I4 open, I5 open, M2 not energized
Rung 3, I4 closed, I5 closed, M3 energized
Rung 4, M3 open, I8 open, I1 closed, M4 energized
Rung 5, M3 closed, I8 closed
Rung 6, M4 closed, M10 closed, T3 closed, M5 energized
Rung 7, M4 closed, I2 open, T4 closed, M6 energized
Rung 8, M7 open
Rung 9, M6 closed, I7 open
Rung 10, M3 closed
Rung 11, I3 open, I8 open, I7 open, M7 not energized
Rung 12, M7 open, I7 open
Rung 13, M6 closed, M11 closed, Q1 energized
Rung 14, Q1 closed, M3 open, Q4 closed, Q3 not energized
Rung 15, Q3 open, T1 not energized
Rung 16, T1 open, M9 (S) not energized
Rung 17, I3 open
Rung 18, M10 open, M9 (R) not energized
Rung 19, Q1 open
Rung 20, Q1 closed, M1 open, M9 open, Q4 not energized
Rung 21, Q4 open
Rung 22, M3 open, M7 open
Rung 23, M3 closed, I3 open
Rung 24, Q4 open, T2 energized (timing)
Rung 25, M3 closed, Q1 closed
Rung 26, T2 open, M10 not energized
Rung 27, I7 closed, Q4 open, M3 open
Rung 28, I1 open, M11 closed, T4 closed
Rung 29, Q1 closed, T3 energized (timing)
Rung 30, M10 open, I8 open, M12 closed, M11 not energized
Rung 31, M2 open, T1 open
Rung 32, M11 open, T4 closed, M12 closed
Rung 33, I8 open, M3 closed, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open In order to raise the platen causing the finished bale to eject, an operator must be at the control panel on the side of the baler where the operator is out of the path of the ejected bale and is in a position to see that the ejection of the bale onto an appropriate carrier is provided for in a safe manner. The operator must pull out on the (STOP/PULL TO RAISE) stop button 75 causing the platen to retract only as long as the operator continues to hold out on the stop/pull to raise button. For the platen to raise the ladder logic program has the following status:

MANUAL UP RAISE PLATEN OPERATION PROGRAM

Rung 1, I4 closed, I5 open, M1 not energized
Rung 2, I4 open, I5 open, M2 not energized
Rung 3, I4 closed, I5 closed, M3 energized
Rung 4, M3 open, I8 open, I1 closed, M4 energized
Rung 5, M3 closed, I8 closed
Rung 6, M4 closed, M10 closed, T3 closed, M5 energized
Rung 7, M5 closed, I2 open, T4 closed, M6 energized
Rung 8, M7 open
Rung 9, M6 closed, I7 open
Rung 10, M3 closed
Rung 11, I3 closed, I8 open, I7 open, M7 not energized
Rung 12, M7 open, I7 open
Rung 13, M6 closed, M11 closed, Q1 energized
Rung 14, Q1 closed, M3 open, Q4 closed, Q3 not energized
Rung 15, Q3 open, T1 not energized
Rung 16, T1 open, M9 (S) energized
Rung 17, I3 closed
Rung 18, M10 open, M9 (R) not energized
Rung 19, Q1 open
Rung 20, Q1 closed, M1 open, M9 closed, Q4 energized
Rung 21, Q4 open
Rung 22, M3 open, M7 open
Rung 23, M3 closed, I3 closed
Rung 24, Q4 open, T2 energized (timing)
Rung 25, M3 closed, Q1 closed
Rung 26, T2 open, M10 not energized
Rung 27, I7 closed, Q4 open, M3 open
Rung 28, I1 open, M11 closed, T4 closed
Rung 29, Q1 closed, T3 energized (timing)
Rung 30, M10 open, I8 open, M12 closed, M11 not energized
Rung 31, M2 open, T1 open
Rung 32, M11 open, T4 closed, M12 closed
Rung 33, I8 open, M3 closed, I3 closed
Rung 34, M11 closed, Q2 energized
Rung 35, M11 open, T4 not energized
Rung 36, I8 open, T4 open, I1 closed Rung 37, I7 open
Rung 38, T4 open, I1 open, M12 not energized
Rung 39, M12 open If the button is released, the platen will stop and the status of the ladder logic program will be:

STOP PLATEN RAISE OPERATION PROGRAM

Rung 1, I4 closed, I5 open, M1 not energized
Rung 2, I4 open, I5 open, M2 not energized
Rung 3, I4 closed, I5 closed, M3 energized
Rung 4, M3 open, I8 open, I1 closed, M4 energized
Rung 5, M3 closed, I8 closed
Rung 6, M4 closed, M10 closed, T3 closed, M5 energized
Rung 7, M5 closed, I2 open, T4 closed, M6 energized
Rung 8, M7 open
Rung 9, M6 closed, I7 open
Rung 10, M3 closed
Rung 11, I3 open, I8 open, I7 open, M7 not energized
Rung 12, M7 open, I7 open
Rung 13, M6 closed, M11 closed, Q1 energized
Rung 14, Q1 closed, M3 open, Q4 closed, Q3 not energized
Rung 15, Q3 open, T1 not energized
Rung 16, T1 open, M9 (S) not energized
Rung 17, I3 open
Rung 18, M10 open, M9 (R) not energized
Rung 19, Q1 open
Rung 20, Q1 closed, M1 open, M9 closed, Q4 not energized
Rung 21, Q4 open
Rung 22, M3 open, M7 open
Rung 23, M3 closed, I3 open
Rung 24, Q4 open, T2 energized (timing)
Rung 25, M3 closed, Q1 closed
Rung 26, T2 open, M10 not energized
Rung 27, I7 closed, Q4 open, M3 open
Rung 28, I1 open, M11 closed, T4 closed
Rung 29, Q1 closed, T3 energized (timing)
Rung 30, M10 open, I8 open, M12 closed, M11 not energized
Rung 31, M2 open, T1 open
Rung 32, M11 open, T4 closed, M12 closed
Rung 33, I8 open, M3 closed, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open When the accumulated retract time is equal to the reset value in the retract timer, the motor powering ram 19 will stop, concluding the "MANUAL UP" operation. The status of the ladder logic program will be:

MANUAL UP END OPERATION PROGRAM

Rung 1, I4 closed, I5 open, M1 not energized
Rung 2, I4 open, I5 open, M2 not energized
Rung 3, I4 closed, I5 closed, M3 energized
Rung 4, M3 open, I8 open, I1 closed, M4 energized
Rung 5, M3 closed, I8 closed
Rung 6, M4 closed, M10 open, T3 closed, M5 not energized, M10 returns to closed
Rung 7, M5 open, I2 open, T4 closed, M6 not energized
Rung 8, M7 open
Rung 9, M6 open, I7 open
Rung 10, M3 closed
Rung 11, I3 open, I8 open, I7 open, M7 not energized
Rung 12, M7 open, I7 open
Rung 13, M6 open, M11 closed, Q1 not energized
Rung 14, Q1 open, M3 open, Q4 closed, Q3 not energized
Rung 15, Q3 open, T1 not energized
Rung 16, T1 open, M9 (S) not energized
Rung 17, I3 open
Rung 18, M10 closed, M9 (R) energized, M10 returns to open
Rung 19, Q1 closed
Rung 20, Q1 open, M1 open, M9 open, Q4 not energized
Rung 21, Q4 open
Rung 22, M3 open, M7 open
Rung 23, M3 closed, I3 open
Rung 24, Q4 open, T2 not energized (timed out)
Rung 25, M3 closed, Q1 open
Rung 26, T2 closed, M10 energized, T2 returns to open, M10 not energized
Rung 27, I7 closed, Q4 open, M3 open
Rung 28, I1 open, M11 closed, T4 closed
Rung 29, Q1 open, T3 not energized
Rung 30, M10 closed, I8 open, M12 closed, M11 not energized, M10 returns to open
Rung 31, M2 open, T1 open
Rung 32, M11 open, T4 closed, M12 closed
Rung 33, I8 open, M3 closed, I3 open
Rung 34, M11 closed, Q2 energized
Rung 35, M11 open, T4 not energized
Rung 36, I8 open, T4 open, I1 closed
Rung 37, I7 open
Rung 38, T4 open, I1 open, M12 not energized
Rung 39, M12 open When the operator has followed the procedures above, the finished bale should be ejected completing the "MANUAL UP" operation and concluding the cycle so that the "AUTO" mode can be initiated again as described above.

Figure 5:
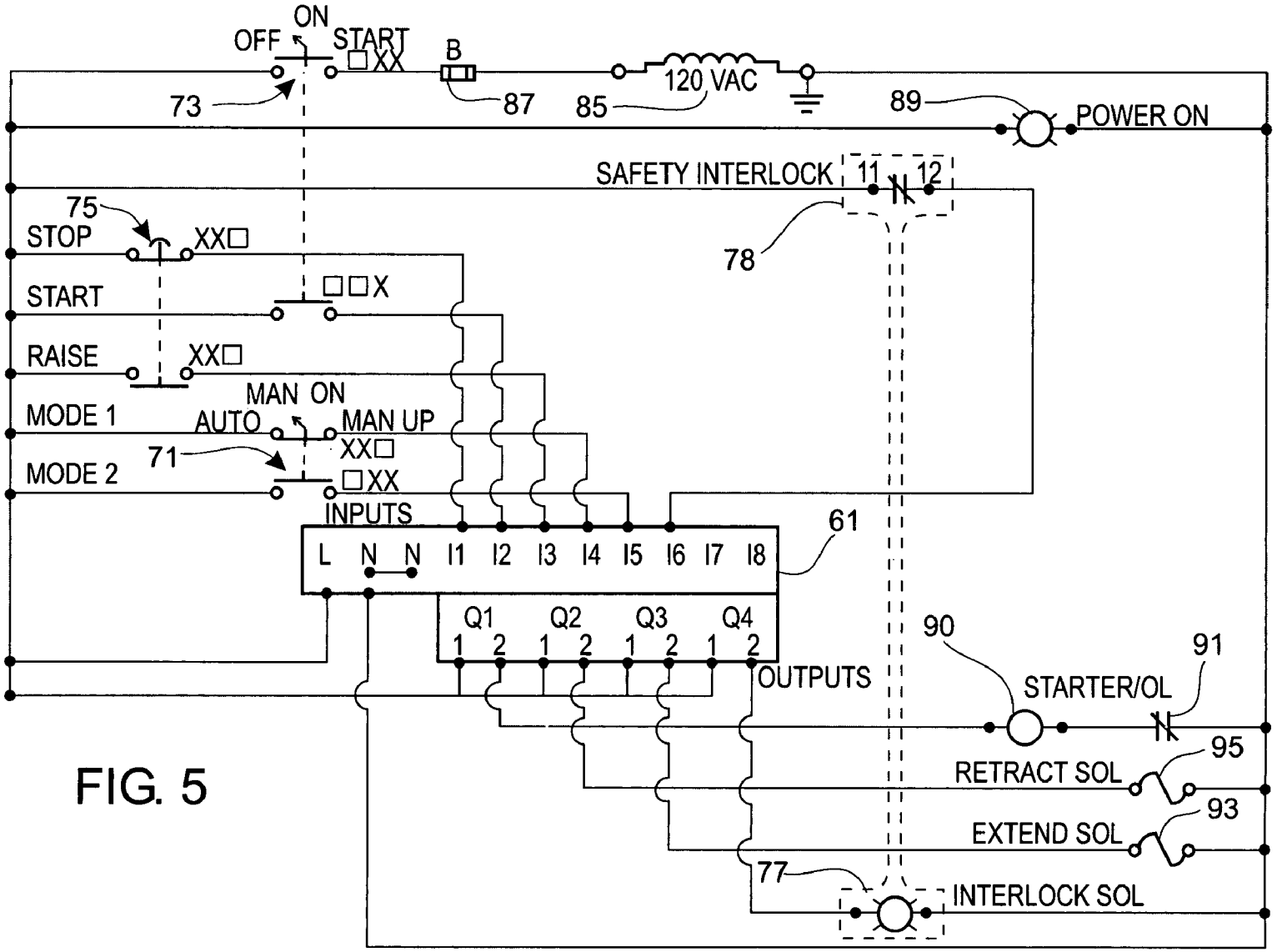
FIG. 5 is a schematic circuit diagram showing connections of the programmable relay and other electrical components of the baler of FIGS. 1, 2, and 3.

FIG. 5 is a schematic circuit diagram showing the hard wired connections of the programmable relay with other electrical components of the baler of FIGS. 1 and 2. Programmable relay 61 is the part of the controller for the baler and is a conventional solid-state electronics device readily available and well known as indicated by the referenced patents.

Electrical outputs of programmable relay 61 are labeled Q1, Q2, Q3, and Q4. Output Q1 supplies a control signal to motor starter 92 for the motor 90 powering hydraulic ram 19 for raising and lowering platen 21 (ram 19 and platen 21 being shown in FIG. 1). An overload protector 91 is shown in circuit with motor starter 92.

Output Q4 controls the interlock solenoid shown schematically at 77. Output Q3 controls the hydraulic extend valve solenoid shown schematically at 93 and output Q2 controls the hydraulic retract valve solenoid shown schematically at 95.

Programmable relay 61 is provided with power terminals L and N receiving AC power from transformer secondary 85 having a fuse 87 in series therewith for protection thereof. As shown at 73, off/on/start key switch is configured to provide power from transformer secondary 85 to all elements of the circuit of FIG. 5 in all positions except the off position. Power on condition is indicated by power on light 89. The three-phase power system for the motor of hydraulic ram 19 is conventional and not shown in detail.

Safety interlock switch 78 is connected to Input 6. Mode select switch 71 is connected to Inputs 4 and 5, being closed to both at the center position.

The off/on/start key switch 73 also has a contact and connection to Input 2. The pull to raise/stop button 75 has contacts connecting input 3 and 1 respectively.

Other operation features may not be readily apparent from the foregoing description. They include the following.

If the stop button is pushed in while the motor is on and if the loading door is closed, the motor will stop and the electromagnetic interlock will de-energize to unlock the loading door. The loading door opening mechanism will open the loading door as it does whenever the electromagnetic interlock is de-energized. The magnetic door interlock will remain un-energized for three seconds and then re-energize.

If the stop button is pushed in while the motor is off and if the loading door is closed, the electromagnetic interlock will de-energize to unlock the loading door. The loading door opening mechanism will open the loading door. The electromagnetic interlock will remain un-energized for three seconds and then re-energize.

If the key switch is moved to the "off" position, all control voltage is off and there is no power to the programmable relay.

If the stop/pull to raise button is pulled out while the motor is running, and if the platen is extended and if the loading door is closed, the platen will shift direction and retract until the accumulated retract time is equal to the preset value in the retract timer. The motor then will stop and the electromagnetic interlock will de-energize to unlock the loading door. The loading door opening mechanism will open the loading door. The electromagnetic interlock will remain un-energized for three seconds and then re-energize.

If the stop/pull to raise button is pulled out while the motor is off and if the key switch is in the "POWER ON" position and if the platen is extended and if the loading door is closed, the motor will start and the platen will retract until the accumulated retract time is equal to the preset value in the retract timer. The motor will stop and the electromagnetic interlock will be de-energized to unlock the loading door. The loading door opening mechanism will open the loading door. The electromagnetic interlock will remain un-energized for three seconds and then re-energized.

Figure 8:
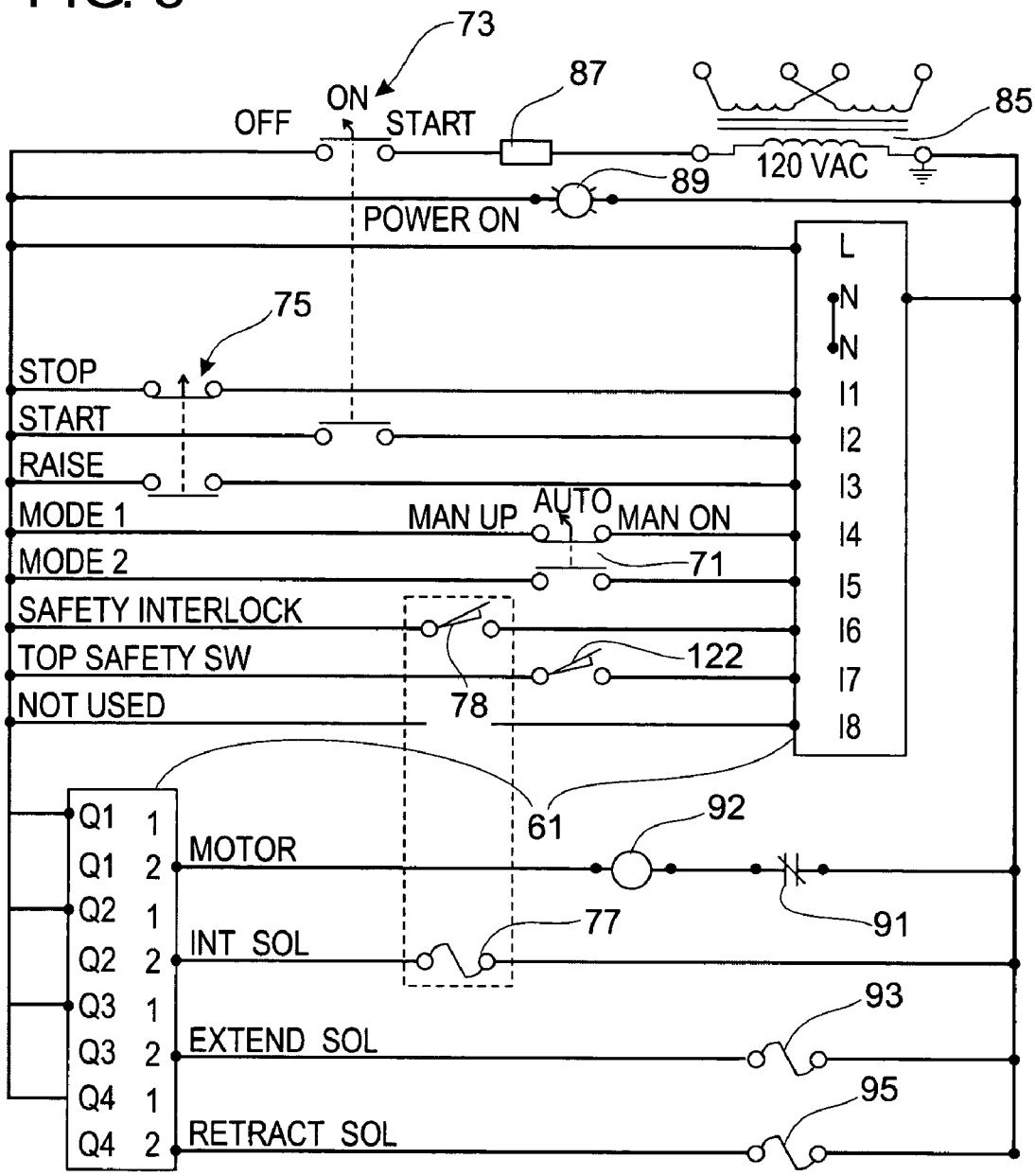
FIG. 8 is an alternative schematic circuit diagram showing connections of the programmable relay and other electrical components of the baler of FIGS. 1, 2, and 3.
Figure 9A:
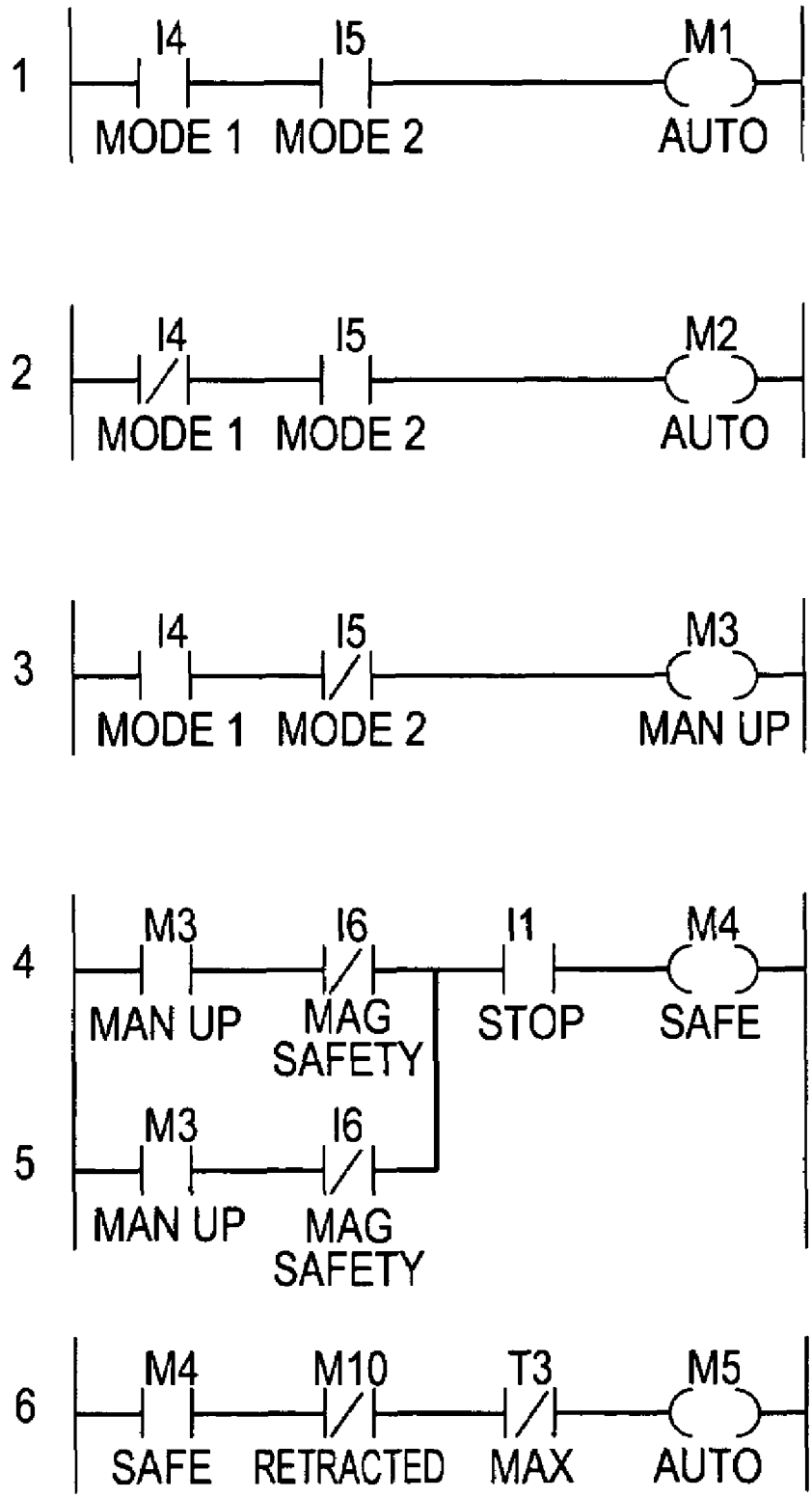
FIGS. 9A through 9E is a diagram of another embodiment of programmable relay configuration for controlling the baler of FIGS. 1 and 2.
Figure 9B:
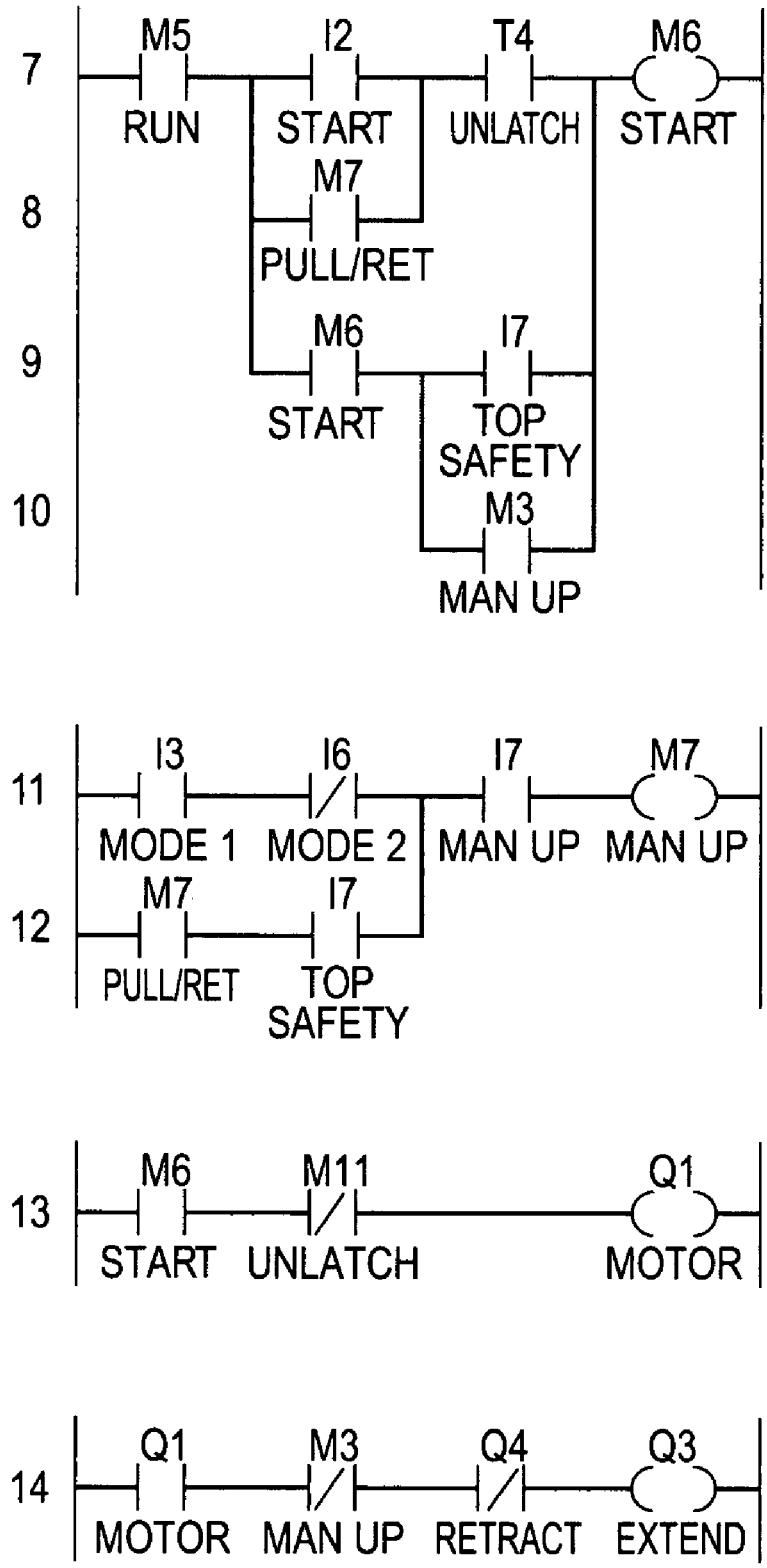
Figure 9C:
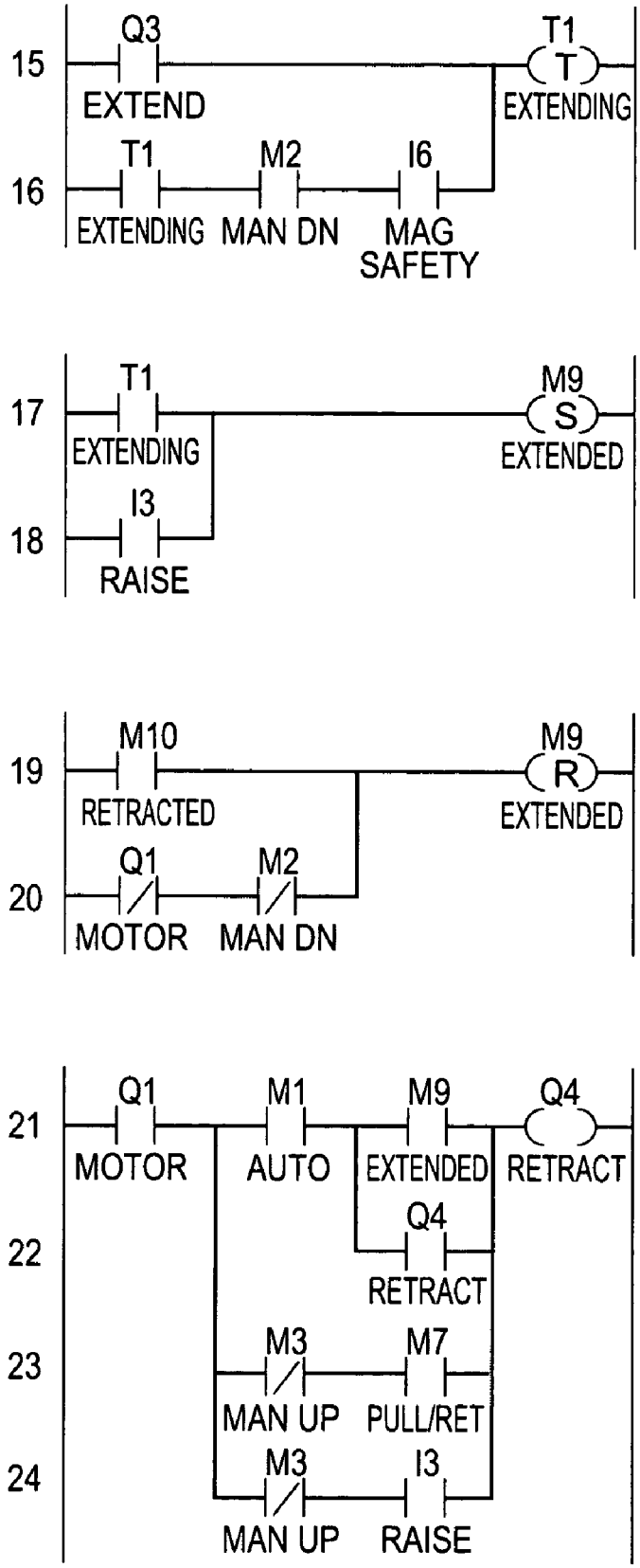
Figure 9D:
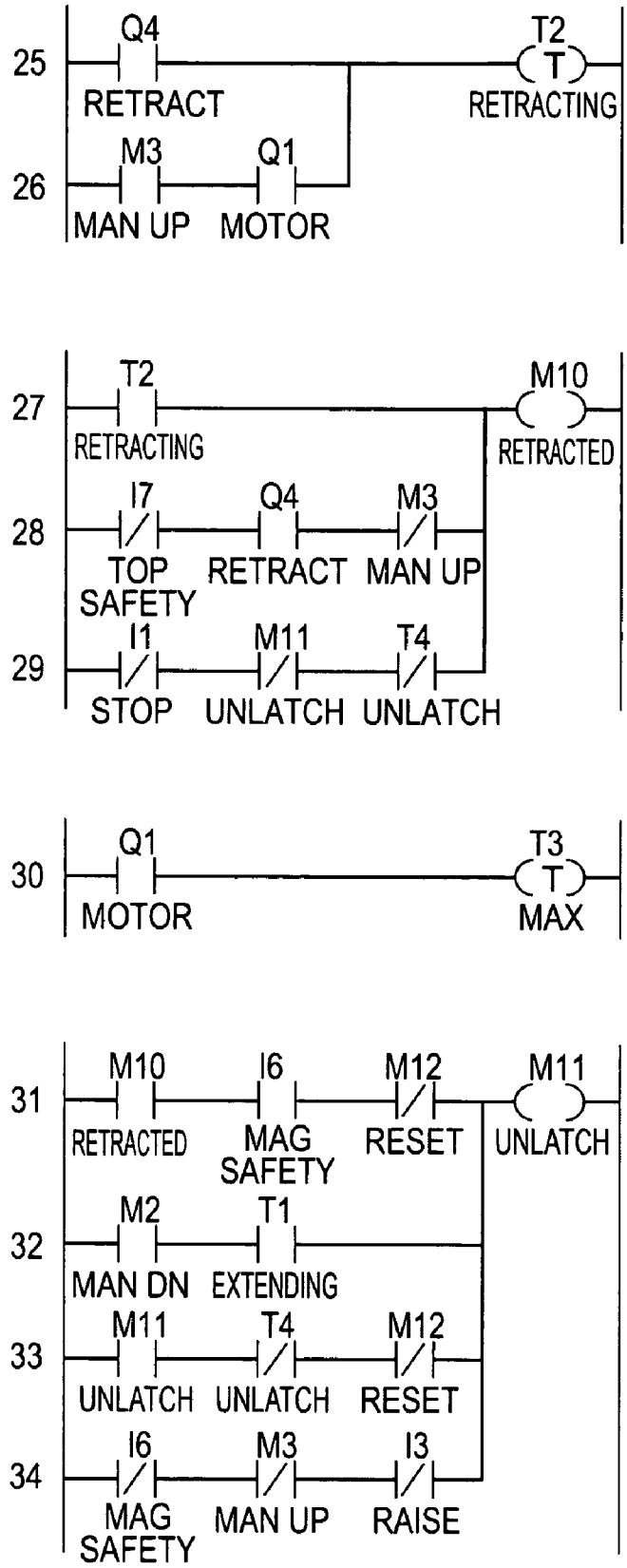
Figure 9E:
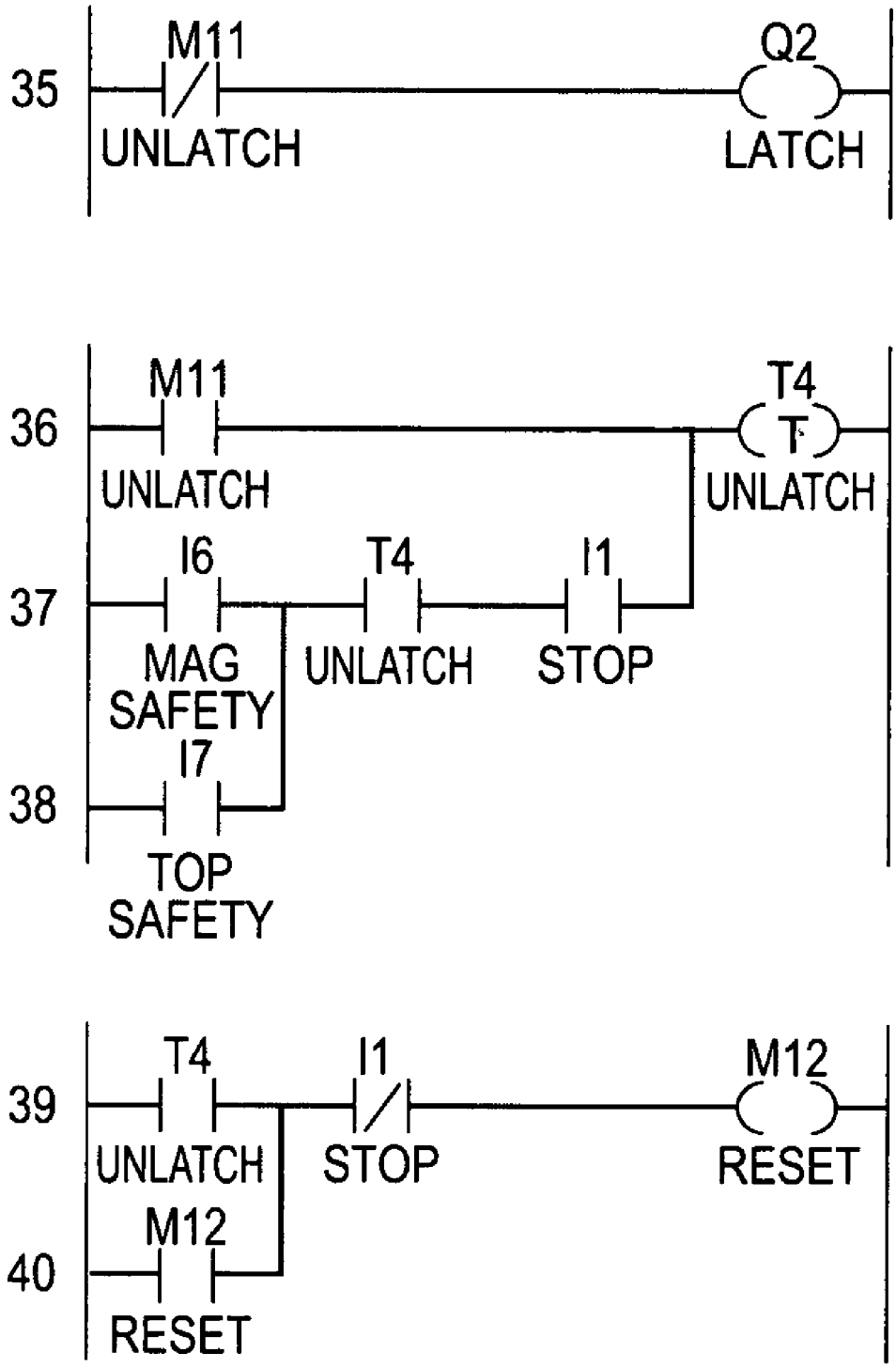

FIG. 8 shows an alternative schematic circuit diagram showing connections of the programmable relay and other electrical components of the baler of FIGS. 1, 2, and 3. Note that a top safety interlock switch 122 has been added to the schematic and connected into input contact 17. Otherwise, the connections of this schematic are very similar to those discussed in FIG. 5.

FIGS. 9A through 9E show a diagram of another embodiment of the programmable relay configuration for controlling the baler of FIGS. 1 and 2. The following provides a description of the program running in the controller: Symbols used:

"I" Represents input contacts that are driven by various switches.

"Q" Represents output contacts that drive various solenoids and coils.

"T" Represents timers that when the coil is energized will begin to time and when the accumulated time value is equal to the preset time value the contacts used throughout the program will change state.

"M" Represents relays that when the coil is energized the contacts used throughout the program will change state.

"M"(S)Represents relays that when the coil is energized the contacts used throughout the program will change state and remain that way if the coil is un-energized until it is reset.

"M"(R) Represents relays that when the coil is energized will reset the "M(S)" contacts.

Inputs "I":

"I1" The Stop contact is a normally closed contact that is controlled by the position of the stop button. Pushed in, the contact will be open. In the center (normal operating position) and when pulled out in the pull to raise position, the contact will be closed. Where used:

| | Position "IN" | Position "CENTER" | Position "OUT" |
|---|---|---|---|
| Rung #4 | OPEN | CLOSED | CLOSED |
| Rung #29 | CLOSED | OPEN | OPEN |
| Rung #37 | OPEN | CLOSED | CLOSED |
| Rung #39 | CLOSED | OPEN | OPEN |

"I2" The Start contact is a normally open contact that is controlled by the position of the key start switch. Turned to the left (OFF position), the contact will be open. In the center (POWER ON position), the contact will be open and when turned to the right (START position), the contact will be closed. Where used:

| | Position "OFF" | Position "POWER ON" | Position "START" |
|---|---|---|---|
| Rung #7 | OPEN | OPEN | CLOSED |

"I3" The Raise contact is a normally closed contact that is controlled by the position of the stop button. Pushed in and in the center (normal operating position), the contact will be open. When pulled out in the pull to raise position, the contact will be closed. Where used:

| | Position "IN" | Position "CENTER" | Position "OUT" |
|---|---|---|---|
| Rung #11 | OPEN | OPEN | CLOSED |
| Rung #18 | OPEN | OPEN | CLOSED |
| Rung #24 | OPEN | OPEN | CLOSED |
| Rung #34 | OPEN | OPEN | CLOSED |

"I4" The Mode select contact #1 is a normally closed contact that is controlled by the position of the mode selector switch. Turned to the center (AUTO position) up (MANUAL UP position), the contact will be closed. In the down (MANUAL DOWN position), the contact will be open. Where used:

| | Position "UP" | Position "CENTER" | Position "DOWN" |
|---|---|---|---|
| Rung #1 | CLOSED | CLOSED | OPEN |
| Rung #2 | OPEN | OPEN | CLOSED |
| Rung #3 | CLOSED | CLOSED | OPEN |

"I5" The Mode select contact #2 is a normally open contact that is controlled by the position of the mode selector switch. Turned to the center (AUTO position), the contact will be closed. In the up (MANUAL UP position), the contact will be open and in the down (MANUAL DOWN position), the contact will be closed. Where used:

| | Position "UP" | Position "CENTER" | Position "DOWN" |
|---|---|---|---|
| Rung #1 | OPEN | CLOSED | CLOSED |
| Rung #2 | OPEN | CLOSED | CLOSED |
| Rung #3 | CLOSED | OPEN | OPEN |

"I6" The electromagnetic door lock contacts are normally open contacts that will close when the lock is energized and the strike plate mounted on the loading door is mated to the surface. Where used:

| | DOOR DOWN | DOOR UP |
|---|---|---|
| Rung #4 | CLOSED | OPEN |
| Rung #5 | OPEN | CLOSED |
| Rung #11 | CLOSED | OPEN |
| Rung #16 | CLOSED | OPEN |
| Rung #31 | CLOSED | OPEN |
| Rung #34 | CLOSED | OPEN |
| Rung #37 | CLOSED | OPEN |

"I7" The Top safety switch contact is a normally open contact that will close when the magnet mounted on the loading door (door is closed) is in proximity to the surface of the switch mounted to a plate on the baler main frame that will open when the platen is retracted. Where used:

| | PLATEN RETRACTED | PLATEN EXTENDED |
|---|---|---|
| Rung #9 | OPEN | CLOSED |
| Rung #11 | OPEN | CLOSED |
| Rung #12 | OPEN | CLOSED |
| Rung #28 | CLOSED | OPEN |
| Rung #38 | OPEN | CLOSED |

Outputs "Q":

The output coil will be energized when the conditions in the rung preceding the coil are in their closed state. When the coil is energized, the contacts used throughout the program will change state (open will close and closed will open).

"Q1" When the coil is energized, the Q1 contacts on the controller will close and energize the motor starter to start the motor. Where used:

| Rung #13 | COIL | |
|---|---|---|
| | ENERGIZED | UN-ENERGIZED |
| Rung #14 | CLOSED | OPEN |
| Rung #20 | OPEN | CLOSED |
| Rung #21 | CLOSED | OPEN |
| Rung #26 | CLOSED | OPEN |
| Rung #30 | CLOSED | OPEN |

"Q2" When the coil is energized, the Q2 contacts on the controller will close and energize the electromagnetic door lock. Where used:

| Rung #35 | COIL |
|---|---|

"Q3" When the coil is energized, the Q3 contacts on the controller will close and energize the extend solenoid on the directional control valve to make the platen extend. Where used:

| Rung #14 | COIL | |
|---|---|---|
| | ENERGIZED | UN-ENERGIZED |
| Rung #15 | CLOSED | OPEN |

"Q4" When the coil is energized, the Q4 contacts on the controller will close and energize the retract solenoid on the directional control valve to make the platen retract. Where used:

| Rung #21 | COIL | |
|---|---|---|
| | ENERGIZED | UN-ENERGIZED |
| Rung #14 | OPEN | CLOSED |
| Rung #22 | CLOSED | OPEN |
| Rung #25 | CLOSED | OPEN |
| Rung #28 | CLOSED | OPEN |

Timers "T":

The timer coil will be energized when the conditions in the rung preceding the coil are in their closed state. When the coil is energized, the contacts used throughout the program will change state (open will close and closed will open) when the coil remains energized until the preset time value is equal to the accumulated time value.

"T1" (Extending timer) When the coil is energized, the platen extend time will be monitored and when the accumulated extend time is equal to the preset time, the contacts used throughout the program will change state. Where used:

| Rung #15 | COIL | |
|---|---|---|
| | ENERGIZED TIMED OUT | UN-ENERGIZED OR TIMING |
| Rung #16 | CLOSED | OPEN |
| Rung #17 | CLOSED | OPEN |
| Rung #32 | CLOSED | OPEN |

"T2" (Retracting timer) When the coil is energized, the platen retract time will be monitored and when the accumulated retract time is equal to the preset time, the contacts used throughout the program will change state. Where used:

| Rung #25 | COIL | |
|---|---|---|
| | ENERGIZED TIMED OUT | UN-ENERGIZED OR TIMING |
| Rung #27 | CLOSED | OPEN |

"T3" (Max run timer) When the coil is energized, the maximum run time will be monitored and when the accumulated extend time is equal to the preset time, the contacts used throughout the program will change state. Where used:

| Rung #30 | COIL | |
|---|---|---|
| | ENERGIZED TIMED OUT | UN-ENERGIZED OR TIMING |
| Rung #6 | OPEN | CLOSED |

"T4" (Unlatch timer) When the coil is energized, the time the electromagnetic door lock is un-energized will be monitored and when the accumulated extend time is equal to the preset time, the contacts used throughout the program will change state. Where used:

| Rung #36 | COIL | |
|---|---|---|
| | ENERGIZED TIMED OUT | UN-ENERGIZED OR TIMING |
| Rung #7 | OPEN | CLOSED |
| Rung #29 | OPEN | CLOSED |
| Rung #33 | OPEN | CLOSED |
| Rung #37 | CLOSED | OPEN |
| Rung #39 | CLOSED | OPEN |

Relays "M":

The relay coil will be energized when the conditions in the rung preceding the coil are in their closed state. When the coil is energized, the contacts used throughout the program will change state (open will close and closed will open).

"M1" (Auto) When the coil is energized, the M1 contacts used throughout the program will change state. Where used:

| Rung #1 | COIL | |
|---|---|---|
| | ENERGIZED | UN-ENERGIZED |
| Rung #21 | CLOSED | OPEN |

"M2" (Manual down) When the coil is energized, the M2 contacts used throughout the program will change state. Where used:

| Rung #2 | COIL | |
|---|---|---|
| | ENERGIZED | UN-ENERGIZED |
| Rung #16 | CLOSED | OPEN |
| Rung #20 | OPEN | CLOSED |
| Rung #32 | CLOSED | OPEN |

"M3" (Manual up) When the coil is energized, the M3 contacts used throughout the program will change state. Where used:

| Rung #3 | COIL | |
|---|---|---|
| | ENERGIZED | UN-ENERGIZED |
| Rung #4 | OPEN | CLOSED |
| Rung #5 | CLOSED | OPEN |

-continued

| | | |
|---|---|---|
| Rung #10 | CLOSED | OPEN |
| Rung #14 | OPEN | CLOSED |
| Rung #23 | OPEN | CLOSED |
| Rung #24 | CLOSED | OPEN |
| Rung #26 | CLOSED | OPEN |
| Rung #28 | OPEN | CLOSED |
| Rung #34 | CLOSED | OPEN |

"M4" (Safe to run) When the coil is energized, the M4 contacts used throughout the program will change state. Where used:

| Rung #4 | COIL | |
|---|---|---|
| | ENERGIZED | UN-ENERGIZED |
| Rung #6 | CLOSED | OPEN |

"M5" (Okay to run) When the coil is energized, the M5 contacts used throughout the program will change state. Where used:

| Rung #6 | COIL | |
|---|---|---|
| | ENERGIZED | UN-ENERGIZED |
| Rung #7 | CLOSED | OPEN |

"M6" (Start) When the coil is energized, the M4 contacts used throughout the program will change state. Where used:

| Rung #7 | COIL | |
|---|---|---|
| | ENERGIZED | UN-ENERGIZED |
| Rung #9 | CLOSED | OPEN |
| Rung #13 | CLOSED | OPEN |

"M7" (Raise/Reverse) When the coil is energized, the M7 contacts used throughout the program will change state. Where used:

| Rung #11 | COIL | |
|---|---|---|
| | ENERGIZED | UN-ENERGIZED |
| Rung #8 | CLOSED | OPEN |
| Rung #12 | CLOSED | OPEN |
| Rung #23 | CLOSED | OPEN |

"M9" (Extended latch) When the coil is energized, the M9 contacts used throughout the program will change state. Where used:

| Rung #17<br>Rung #19 | LATCH COIL<br>RESET COIL | |
|---|---|---|
| | LATCHED | RESET |
| Rung #21 | CLOSED | OPEN |

"M10" (Retracted) When the coil is energized, the M10 contacts used throughout the program will change state. Where used:

| Rung #27 | COIL | |
|---|---|---|
| | ENERGIZED | UN-ENERGIZED |
| Rung #6 | OPEN | CLOSED |
| Rung #19 | CLOSED | OPEN |
| Rung #31 | CLOSED | OPEN |

"M11" (Unlatch door) When the coil is energized, the M11 contacts used throughout the program will change state. Where used:

| Rung #31 | COIL | |
|---|---|---|
| | ENERGIZED | UN-ENERGIZED |
| Rung #13 | OPEN | CLOSED |
| Rung #29 | OPEN | CLOSED |
| Rung #33 | CLOSED | OPEN |
| Rung #35 | OPEN | CLOSED |
| Rung #36 | CLOSED | OPEN |

"M12" (Reset unlatch) When the coil is energized, the M12 contacts used throughout the program will change state. Where used:

| Rung #39 | COIL | |
|---|---|---|
| | ENERGIZED | UN-ENERGIZED |
| Rung #31 | OPEN | CLOSED |
| Rung #33 | OPEN | CLOSED |
| Rung #40 | CLOSED | OPEN |

From the foregoing discussion, it will be seen that the control circuit and the programmable relay provide for both expected and unexpected operator actions at the control panel thereby preventing problems with a control system function that could require supervisory activity beyond the operator's ability.

From FIGS. 1–9 it will be seen that the control system of the programmable relay and associated components serve to effectively provide all of the functions of the baler including waste acceptance, compaction, and bale ejection in a safe and efficient manner with a minimum of complexity using a relatively small number of interlocking and locking devices.

While the control program and circuit described above is explained in relation to cooperation with a particular form of bale dump tray and ejection mechanism coupling the bale dump tray and the baler platen, its usefulness is not limited to this particular form of baler and ejection mechanism but is suitable with or adaptable to other forms of compaction apparatus.

In addition to the alternative forms of implementation of the apparatus shown, suggested, or described above, it will be apparent to those skilled in the art that other modifications and variations to the apparatus can be employed and accordingly the scope of the invention is not to be limited to the variations explicitly described but is rather to be determined by reference to the appended claims.

What is claimed is:

1. A compaction control apparatus for a waste compactor having a waste chamber with a front and back, a hydraulic ram powered by an electric motor, a platen retracted and extended by said ram, a loading door mounted for vertical sliding movement and an unloading opening, and a chamber door on the front of the chamber, the compaction control apparatus comprising:

an electromagnetic interlock and sensor switch arranged to interlock the loading door and the chamber door;

an off/on/start switch;

an interlock solenoid connected to the electromagnetic interlock;

at least one gas spring configured with the loading door to apply an upward force sufficient to raise the loading door to its uppermost position; and a plurality of relays interconnected to prevent hazardous baler operations including undesired ram extension or retraction when either of the chamber door or loading door is sensed by the electromagnetic interlock and sensor switch to be improperly positioned for such operation.

2. The apparatus of claim 1, the door having a weight;

the lifting forces of the at least one gas spring providing a sufficient force to retain the door in an extended position.

3. The apparatus of claim 1, the door having a weight;

the lifting forces of the at least one gas spring providing sufficient force to raise the door when the gas springs are in a compressed position.

4. The apparatus of claim 1, the door having a weight;

the at least one gas spring comprising two gas springs; and the combined lifting forces of the two gas springs providing sufficient force to hold the door in an extended position.

5. The apparatus of claim 1, the door having a weight;

the at least one gas spring comprising two gas springs; and the combined lifting forces of the two gas springs providing sufficient force to raise the door when the gas springs are in a compressed position.

6. The apparatus of claim 1, the gas springs operating over a range of travel;

the gas springs including damping features active over at least one inch of the travel.

7. The apparatus of claim 1, the gas springs operating over a range of travel;

the gas springs including damping features active over less than five inches of the travel.

8. A compaction control apparatus for a waste compactor having a waste chamber with a front and back, a hydraulic ram powered by an electric motor, a platen retracted and extended by said ram, a loading door mounted for vertical sliding movement and an unloading opening, and a chamber door on the front of the chamber, the compaction control apparatus comprising:

an electromagnetic interlock and sensor switch arranged to interlock the loading door and the chamber door;

an off/on/start switch;

at least one gas spring configured with the loading door to apply an upward force sufficient to raise the loading door to its uppermost position; and at least one relay responsive to said electromagnetic interlock and connected to prevent hazardous baler operations including undesired ram extension or retraction when either of the chamber door or loading door is sensed by the electromagnetic interlock and sensor switch to be improperly positioned for such operation.

* * * * *